US006643477B2

(12) United States Patent
Mitsuoka et al.

(10) Patent No.: US 6,643,477 B2
(45) Date of Patent: Nov. 4, 2003

(54) HEATING DEVICE AND IMAGE FORMING APPARATUS USING THE SAME

(75) Inventors: Tetsunori Mitsuoka, Habikino (JP); Toshiaki Kagawa, Kitakatsuragi-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/109,304

(22) Filed: Mar. 28, 2002

(65) Prior Publication Data

US 2002/0141775 A1 Oct. 3, 2002

(30) Foreign Application Priority Data

Mar. 30, 2001 (JP) ..... 2001-100105
Dec. 14, 2001 (JP) ..... 2001-382067

(51) Int. Cl.[7] ..... G03G 15/20
(52) U.S. Cl. ..... 399/69; 399/45; 399/68
(58) Field of Search ..... 399/69, 45, 68, 399/70, 43; 219/216

(56) References Cited

U.S. PATENT DOCUMENTS 6,314,252 B1 * 11/2001 Matsumoto ..... 399/45

FOREIGN PATENT DOCUMENTS

| | | |
|---|---|---|
| JP | 60-022164 | 2/1985 |
| JP | 08-211779 | 8/1996 |
| JP | 2696908 | 9/1997 |

* cited by examiner

*Primary Examiner*—Quana M. Grainger
(74) *Attorney, Agent, or Firm*—David C. Conlin; David A. Tucker; Edwards & Angell, LLP

(57) ABSTRACT

When the paper size signal indicates small-sized paper, after the final sheet of a consecutive sheet feed operation of that size has passed through the heating device, paired rollers consisting of heat and pressing rollers are actuated to rotate for a predetermined period (rotational mode) while no sheet passes therethrough. After completion of the rotational mode, the paired rollers are stopped from rotating for a predetermined period (stationary mode).

15 Claims, 24 Drawing Sheets

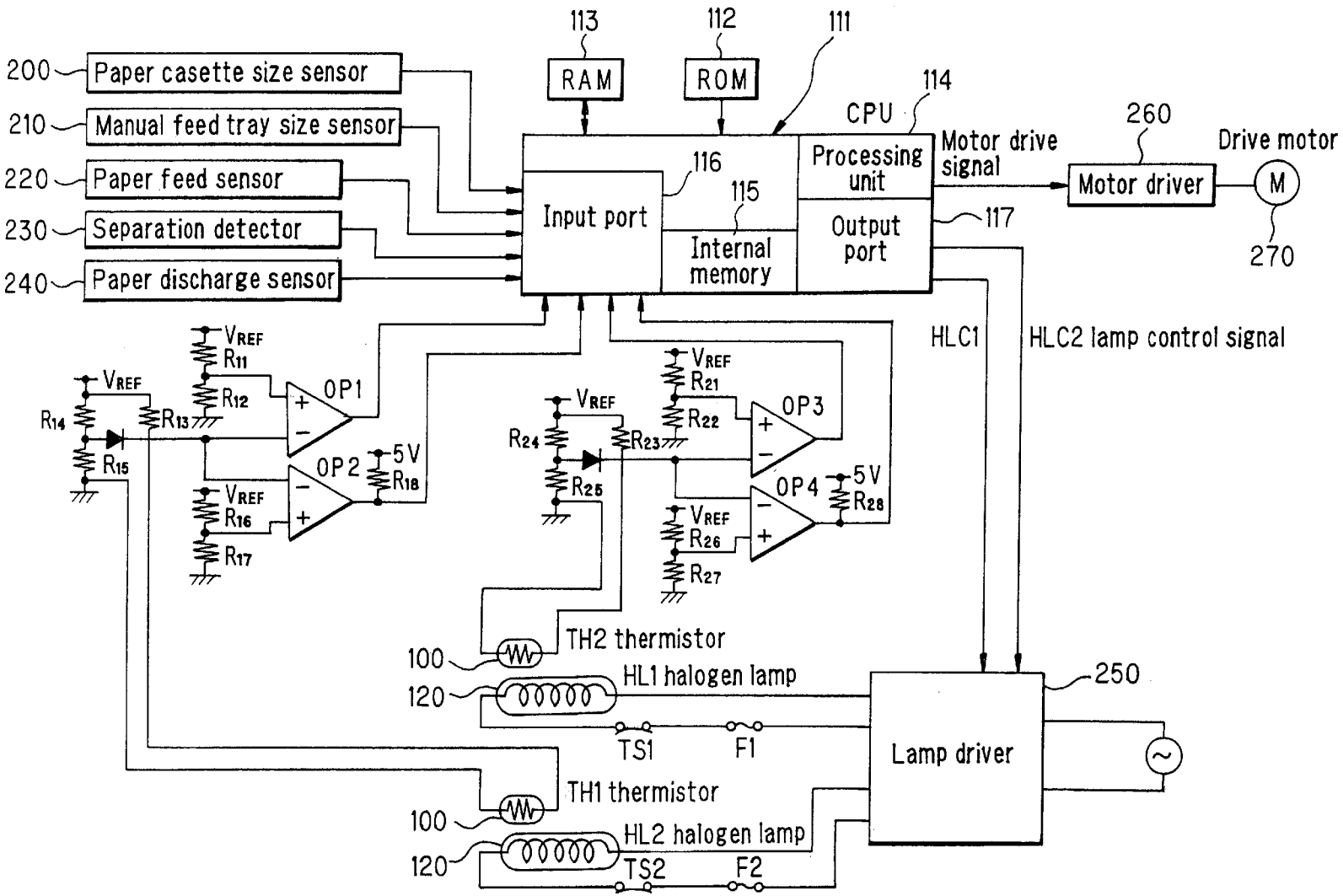
FIG. 6
Drive motor
M
270
Motor driver
260
Motor drive signal
HLC2 lamp control signal
HLC1
117
114
CPU
Processing unit
Output port
111
112
ROM
115
Internal memory
116
113
RAM
Input port
Lamp driver
250
5V
R28
OP3
OP4
VREF
R21
R22
R23
R24
R25
R26
R27
TH2 thermistor
HL1 halogen lamp
F1
TS1
TH1 thermistor
HL2 halogen lamp
F2
TS2
100
120
OP1
OP2
R11
R12
R13
R14
R15
R16
R17
R18
Paper casette size sensor
Manual feed tray size sensor
Paper feed sensor
Separation detector
Paper discharge sensor
200
210
220
230
240

HEATING DEVICE AND IMAGE FORMING APPARATUS USING THE SAME

BACKGROUND OF THE INVENTION (1) Field of the Invention

The present invention relates to a heating device suitably used for the fixing unit of a dry type electrophotographic apparatus, the drying device of a wet type electrophotographic apparatus, the drying device of an ink-jet printer, a rewritable media erasing device and the like, as well as relating to an image forming apparatus using this heating device.

(2) Description of the Prior Art

In a typical heating device for the electrophotographic process, the toner on the paper surface as a recording medium is fixed on the paper by fusing and solidification. While paper of a smaller width compared to the heating width of the heating element is passed through the heating device, heat energy is supplied from the heat source also to the non-paper feed areas through which paper of a smaller width does not pass. However, since there is no paper to which heat can transfer in the non-paper feed areas, heat builds up in these areas, causing excessive temperature rise therein.

If paper of a greater width than the small-width paper is passed through under this condition, deficiencies as follows will occur due to the temperature imbalance between the paper feed area (at the middle) of the small-width paper and the non-paper feed areas (at both sides).

First, due to temperature imbalance, when paper of greater width is passed through, it becomes wrinkled at the areas corresponding to the non-paper feed areas of small-width paper.

Second, since the non-paper feed areas are overheated, if paper with an unfixed image thereon is passed through, to be fixed, under this condition, image deficiencies such as high-temperature offset will occur.

Third, since the heat roller surface is coated with an non-stick layer of fluororesin or the like in order to improve the separability when fixing, this non-stick layer will be heated to high temperatures in the overheated areas, causing heat deterioration and lowering of its durability.

Generally, in order to assure adhesion between the non-stick layer and the metal core of the heat roller, a primer such as a silicon resin adhesive, undercoating or the like is provided. Therefore, due to degradation of the primer itself and due to degradation of the non-stick layer, the bonding strength between the non-stick layer and the primer or that between the primer and the metal core lowers, as a result the non-stick layer and/or primer may peel off.

To solve the above problems, there have been several conventional methods proposed: examples include a method of lowering the surface temperature by forcibly rotating the heating element after passage of printing paper (e.g., Japanese Patent Application Laid-Open Hei 8 No. 21779), a method of naturally cooling the heating element surface by holding the heating element still after passage of printing paper (e.g., Japanese Patent 2696908) and a method of forcibly cooling the overheated parts or the whole of the heating element using a blower such as a fan etc. Further, in order not to generate inefficient heat in the non-paper feed areas during printing, there has been another approach (Japanese Patent Application Laid-Open Sho 60 No. 22164), with which the heat roller is adapted to incorporate divided, or multiple parts, of heat sources in conformity with the sizes of paper that pass over the heat sources.

Next, these prior art techniques will be described in further detail.

(1) The Method Disclosed in Japanese Patent Application Laid-Open 8 No. 211779:

The method disclosed in Japanese Patent Application Laid-Open 8 No. 211779 is aimed at providing a compact and economic fixing unit in which improvements against fixing defects, offsets and the like attributed to the temperature distribution imbalance across the heat roller are made.

More specifically, the controller for regulating the temperature distribution across the heat roller of the fixing unit, as it is commanded to start a new job, estimates the current temperature distribution across the heat roller based on the information as to the previous job and the elapsed time from the end of the job and judges whether the new job is permitted under the present conditions.

If the controller has determined that the heat roller is not uniform in temperature, the controller performs its control such that the heat roller is idly rotated for a fixed period of time before start of the next job, the set temperature is changed before start of the next job, or all the operations are prohibited for a fixed period.

By effecting such control, the next copy job can be started after the heat roller has become uniform in the temperature distribution, without being affected by the previous copying job.

In the above cooling method, there is a risk that the heating element might be partially reduced in temperature to a temperature lower than the functional fixing temperature range because the heating element which has been uneven in temperature is cooled. To lessen this possibility, there is also a proposed method in which the heating element as a whole is heated after the cooling.

(2) The Method Disclosed in Japanese Patent 2696908:

In the method disclosed in Japanese Patent 2696908, if paper of a smaller size than B5, e.g., postcards or smaller, is detected, the copying operation of the small-sized paper alone is halted for a predetermined period, whereby the non-paper feed areas in the heat roller of the fixing unit are inhibited from being elevated in temperature.

More explicitly, in an image forming apparatus having a roller type fixing unit made up of a heat roller and pressing roller put in pressing contact with each other, continuous copying operations of paper of a size smaller than B5 such as postcards, are allowed until the temperature of the non-paper feed areas on the heat roller of the fixing unit becomes elevated to a predetermined temperature, and then after reaching the predetermined temperature, copying operation of the small-size paper alone is halted over a predetermined period of time so that the non-paper feed areas of the heat roller will not become overheated. This halt is continued until the temperature distribution across the heat roller becomes uniform.

(3) The Method Disclosed in Japanese Patent Application Laid-Open Sho 60 No. 22164:

In the method disclosed in Japanese Patent Application Laid-Open Sho 60 No. 22164, temperature control in conformity with the recording paper size is enabled in order not to generate unnecessary heat in the non-paper feed areas during printing.

More clearly, in conformity with the size of recording paper conveyed through the fixing unit, multiple heater elements arranged in the fixing unit are selectively energized. Further, the power of each heater element is also controlled so as to optimize the temperature distribution.

As stated above, in the method disclosed in Japanese Patent Application Laid-Open Hei 8 No. 211779, when the surface temperature of the heat roller has risen, to decrease the temperature the paired rollers, i.e., heat roller and pressing roller, are idly turned for forcible cooling.

However, in order to decrease the temperature difference between the paper feed area and the non-paper feed areas to a small enough level, it is necessary to idly rotate the heat roller for a long time. Accordingly, extra time is needed until the next copying operation is allowed to start, resulting in reduction in throughput.

In the method disclosed in Japanese Patent 2696908, upon a copying operation using small-sized recording paper, the copying operation of small-sized paper alone is halted for a predetermined period, so that the temperature of the heat roller can fall within the range in which copying operations can be implemented.

Solitary prohibition of the copying operation of small sized paper for the predetermined period of time makes it possible to reduce the temperature difference between the paper feed area and the non-paper feed areas to a certain small level. However, it is necessary to take a long halt in order to reduce the temperature of the non-paper feed areas to a level at which the copying operation is allowed. Accordingly, extra time is needed until the next copying operation is allowed to start. That is, this configuration needs long inactive time hence long intervals between copying operations, resulting in reduction in throughput.

In the method disclosed in Japanese Patent Application Laid-Open Sho 60 No. 22164, multiple heat sources are used in conformity with the paper size so as to prevent temperature rise in the non-paper feed areas. Nevertheless, since this configuration does not have any efficient cooling means in combination, reduction in temperature cannot be achieved fast enough, hence it is impossible to obtain satisfactory effect in spite of increase in cost due to provision of multiple heat sources.

SUMMARY OF THE INVENTION

The present invention has been devised in view of the above problems and it is therefore an object of the present invention to provide a heating device, as well as an image forming apparatus using it, which can quickly restore a heat roller from an overheated state, without causing any paper wrinkles or causing any image degradation and can make control so as to uniformly keep the overall temperature distribution across the heat roller within a predetermined temperature range.

In order to achieve the above object the heating device according to the present invention and the image forming apparatus using it are configured as follows:

In accordance with the first aspect of the present invention, a heating device having a heating element including a heat source and a pressing element put in pressing contact with the heating element, wherein recording media are passed through and between the two elements so as to heat the media, the heating device comprises: a rotational drive means for rotating the heating element and pressing element; and a control means for making control of each part so as to implement a cooling process for cooling the heating element, and is characterized in that when the final recording medium in a consecutive heating operation of recording media of a solitary size has passed through and between the heating element and pressing element, the control means implements two different modes in combination in accordance with the size of the recording media, the rotational mode in which the heating element and pressing element are rotated by the rotational drive means for a predetermined period of time and the stationary mode in which the heating element and pressing element are stopped rotating by the rotational drive means for a predetermined period of time.

In accordance with the second aspect of the present invention, the heating device having the above first feature is characterized in that the control means implements the stationary mode after the operation in the rotational mode.

In accordance with the third aspect of the present invention, the heating device having the above first feature is characterized in that the control means implements the rotational mode after the operation in the stationary mode.

In accordance with the fourth aspect of the present invention, the heating device having the above first feature is characterized in that the control means deactivates the heat source while the operation is being implemented in at least one of the modes, the rotational and stationary modes.

In accordance with the fifth aspect of the present invention, the heating device having the above first feature is characterized in that the control means makes control during the cooling process so that the temperature of the heating element is maintained so as to fall within a predetermined range.

In accordance with the sixth aspect of the present invention, the heating device having the above fifth feature is characterized in that the control means set the operational conditions for the cooling process, based on the optimal cooling process conditions stored beforehand and the recording media information at least including the size of recording media and the number of media in the previous heating process.

In accordance with the seventh aspect of the present invention, the heating device having the above fifth feature is characterized in that the control means makes control so as to keep the temperature within the predetermined range when the operation is implemented in the stationary mode.

In accordance with the eighth aspect of the present invention, the heating device having the above first feature further includes: a recording media size detecting means for detecting the size of recording media and is characterized in that when the control means, after a previous heat process has been finished, confirms that a subsequent heat process should be implemented, the control means implements the cooling process if the recording media size detecting means indicates that the media size of the subsequent heat process is greater than that of the previous heat process, and the control means will not implement the cooling process if the media size of the subsequent heat process is equal to or smaller than that of the previous heat process.

In accordance with the ninth aspect of the present invention, the heating device having the above fifth feature is characterized in that the control means, after completion of the cooling process, actuates an energy save mode operation in which the temperature range of the heating element is shifted to another temperature range which is slightly lower to a certain degree than the predetermined temperature range and can be immediately restored to the predetermined temperature range.

In accordance with the tenth aspect of the present invention, the heating device having the above first feature is characterized in that the control means makes control such that the cooling process is stopped in accordance with the size of recording media passing through and between the heating element and the pressing element.

In accordance with the eleventh aspect of the present invention, the heating device having the above first feature is characterized in that the control means makes control so that the rotational mode and stationary mode are repeated alternately a multiple number of times.

In accordance with the twelfth aspect of the present invention, the heating device having the above first feature is characterized in that when the control means determines that the temperature of the heating element has been elevated, deviating from the predetermined temperature range, the control means makes control so that the rotational mode starts first.

In accordance with the thirteenth aspect of the present invention, the heating device having the above first feature is characterized in that when the control means determines that the mean temperature of the heating element falls within the predetermined range but the spatial temperature distribution has strong fluctuations, the control means makes control so that the stationary mode starts first.

In accordance with the fourteenth aspect of the present invention, the heating device having the above fifth feature is characterized in that the heating element includes a multiple number of heat sources assigned for different heating areas, and the control means makes temperature control of each heat source corresponding to an individual heating area, independently from others.

In accordance with the fifteenth aspect of the present invention, the heating device having the above first feature further includes a temperature detecting means for measuring the temperature of the heating element and is characterized in that the control means sets the operational conditions for the cooling process, based on the temperature information obtained from the temperature detecting means.

In accordance with the sixteenth aspect of the present invention, the heating device having the above fifth feature further includes a temperature detecting means for measuring the temperature of the heating element and is characterized in that the control means sets the operational conditions for the cooling process, based on the temperature information obtained from the temperature detecting means.

In accordance with the seventeenth aspect of the present invention, an image forming apparatus for forming toner images on recording media, includes, as a fixing unit for fixing toner images on the recording media, a heating device comprising: a heating element including a heat source; a pressing element put in pressing contact with the heating element; a rotational drive means for rotating the heating element and pressing element so as to pass the recording media through and between the two elements so as to heat the media; and a control means for making control of each part so as to implement a cooling process for cooling the heating element, wherein when the final recording medium in a consecutive heating operation of recording media of a solitary size has passed through and between the heating element and pressing element, the control means implements two different modes in combination in accordance with the size of the recording media, the rotational mode in which the heating element and pressing element are rotated by the rotational drive means for a predetermined period of time and the stationary mode in which the heating element and pressing element are stopped rotating by the rotational drive means for a predetermined period of time.

In the heating device according to the present invention, when the final recording medium has passed through the heating device, a cooling and post process is effected by combination of the rotational mode in which the heating element and pressing element are rotated for a predetermined period of time and the stationary mode in which the heating element and pressing element are stopped rotating for a predetermined period of time. In this way, the cooling process is effected by implementing the two modes in combination, hence it is possible to lower the surface temperature of the heating element and pressing element, more quickly compared to the prior art techniques.

Further, the two modes produce individual influences different from each other when the surface temperatures of the heat and pressing rollers are lowered. Specifically, the rotational mode functions such that the differential temperature between the non-media feed areas which are overheated and the media feed area cannot be reduced to a small enough level but the maximum temperature in the non-media feed areas lowers or the temperature across the whole part totally lowers at a high temperature drop rate. On the other hand, the stationary mode functions such that the differential temperature between the non-media feed areas and the media feed area can be markedly reduced compared to the rotational mode.

Accordingly, it is possible to lower the temperature in the non-media feed areas which is overheated more quickly by implementing the rotational mode and the stationary mode for predetermined periods specified in accordance with the size of recording media. Therefore, it is possible to quickly restore the normal state from the condition in which occurrence of wrinkles and image deficiencies such as high-temperature offset may arise as well as avoiding reduction in throughput of image forming.

BRIEF DESCRIPTION OF THE DRAWINGS

FIG. 6 is a block diagram showing an example of a controller according to the present invention;

FIG. 8C showing the axial temperature distribution in the combination mode where the rotational and stationary modes are implemented serially;

DESCRIPTION OF THE PREFERRED EMBODIMENTS

The embodiment of a control method of a fixing unit and its controller according to the present invention will hereinafter be described with reference to the accompanying drawings.

<Overall Configuration>

The heating device according to the present invention is applied to a fixing unit in a dry electrophotographic apparatus, a dryer in a wet electrophotographic apparatus, a dryer in an ink-jet printer, an erasing device for rewritable media and the like.

Figure 2:
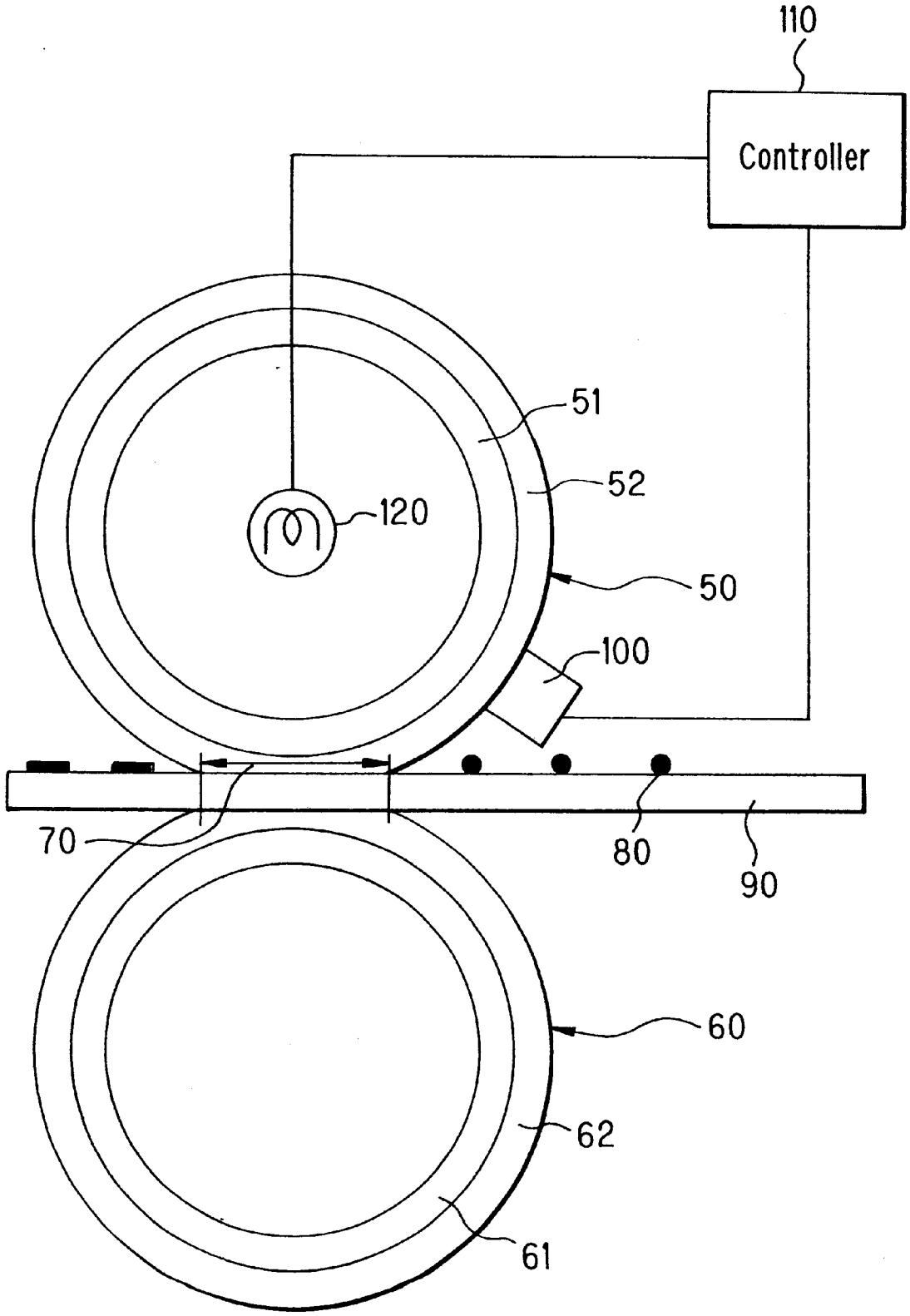
FIG. 2 is a diagram showing the schematic configuration of a fixing unit using a lamp heating system.
Figure 13:
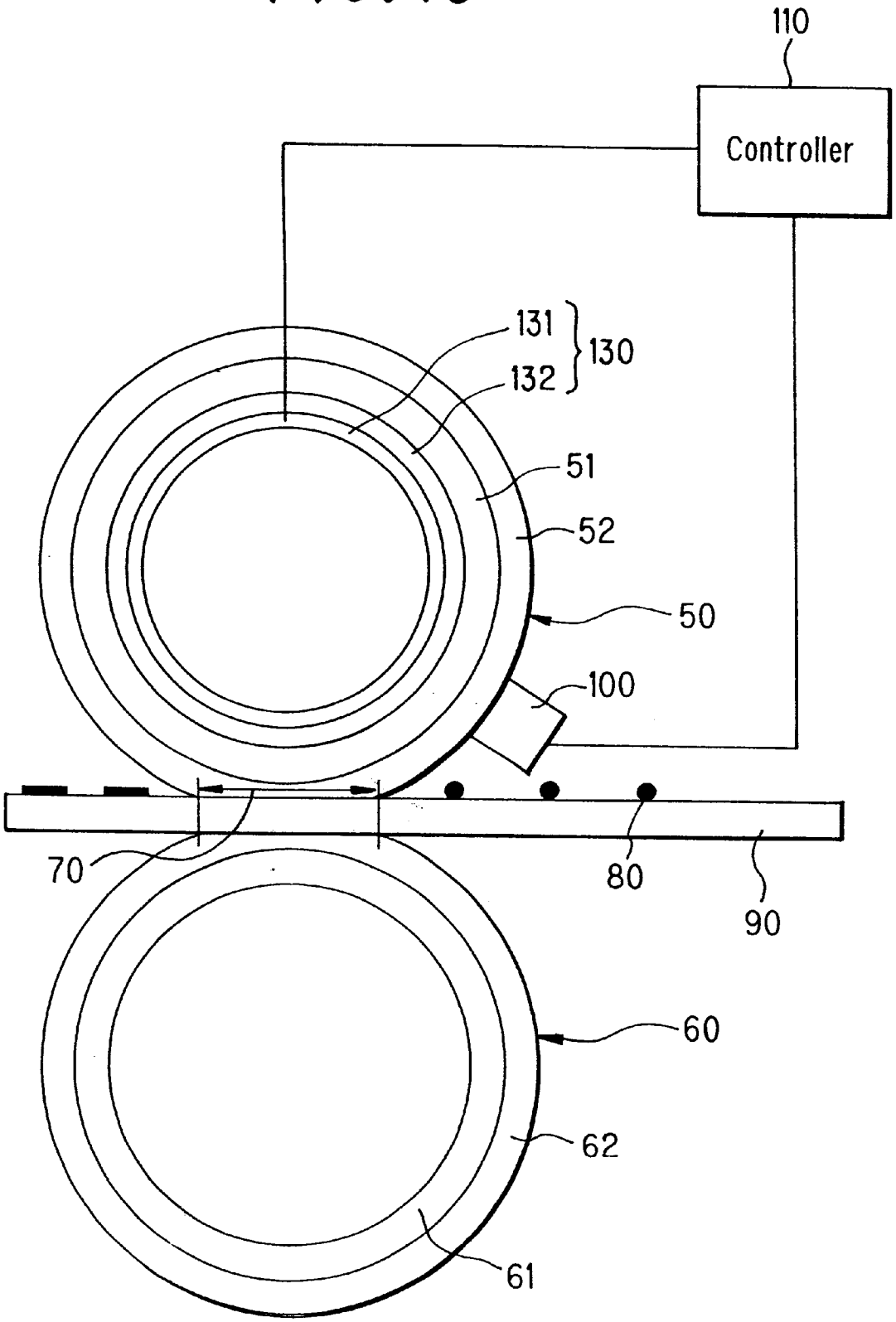
FIG. 13 is a diagram showing the schematic configuration of a fixing unit using a direct heating system.
Figure 15:
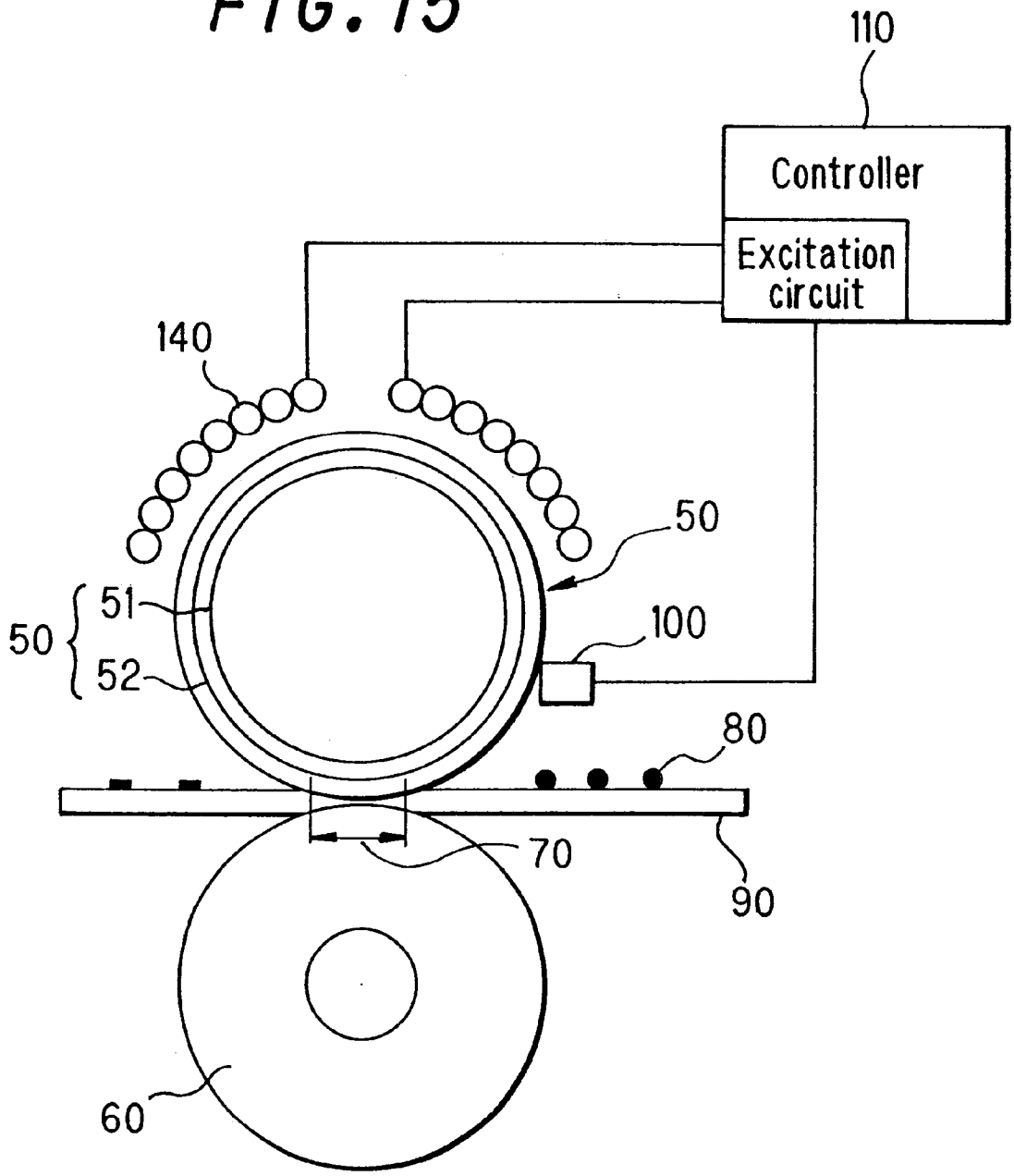
FIG. 15 is a diagram showing the schematic configuration of a fixing unit using an induction heating system.

Here, description will be made taking an example of a fixing unit in a dry electrophotographic apparatus. In this unit, as is shown in FIGS. 2, 13 and 15, a heat roller 50 as a heating element and a pressing roller 60 as a pressing element are arranged opposing each other so that the two rollers 50 and 60 are put in pressing contact with each other at a nip 70. A recording sheet 90, as a recording medium, with toner 80 adhering thereto is made to pass through the nip between the two rollers 50 and 60, whereby the toner 80 is fixed onto recording sheet 90.

Arranged in contact with or in proximity to heat roller 50 is a temperature detecting means consisting of a thermistor 100, etc, and the detected output from the temperature detecting means is input to a controller 110. This controller 110, based on the detected output from the temperature detecting means, controls each part of the heating device so as to keep heat roller 50 at a predetermined temperature.

<Roller Configuration>

Heat roller 50 is provided with a halogen lamp 120 (FIG. 2), a heating sheet 130 (FIG. 13) or a magnetic field generator 140 (FIG. 15), as a heat source (detailed description as to the heat sources will be made later). The heat roller 50 shown in FIG. 2 is comprised of a metal core 51 with an non-stick layer 52 formed on its outer peripheral side. The heat roller 50 shown in FIG. 13 is comprised of a metal core 51 with an non-stick layer 52 formed on its outer peripheral side and further includes heating sheet 130 which is made up of a resistance heater 131 and a heat resistant insulative material 132 and arranged on the inner periphery of metal core 51. The heat roller 50 shown in FIG. 15 is comprised of a metal core 51 consisting of a conductive layer with an non-stick layer 52 formed on its outer peripheral side. Pressing roller 60 is composed of a core metal 61 and an non-stick layer 62 formed on its outer peripheral side, as shown in FIGS. 2 and 13.

<Controller Configuration>

In the heating device according to the embodiment of the present invention, one or more thermistors 100 are connected.

This thermistor 100 is a device for detecting the surface temperature of heat roller 50 as a heating element and is arranged in contact with or in proximity to heat roller 50. Thermistor 100 has a resistance element attached to the tip thereof which varies its resistance depending on the temperature. This resistance element is put in contact with or in proximity to non-stick layer 52 on the surface of heat roller 50.

Controller 110 controls and energizes the heat source by a switching element when the surface temperature of heat roller 50 detected by thermistor 100 does not reach the predetermined target temperature, to supply heat energy to heat roller 50.

When the surface temperature of heat roller 50 detected by thermistor 100 reaches the predetermined target temperature, the controller causes the switching element to switch the heat source off, to stop heat energy supply to heat roller 50.

Figure 1:
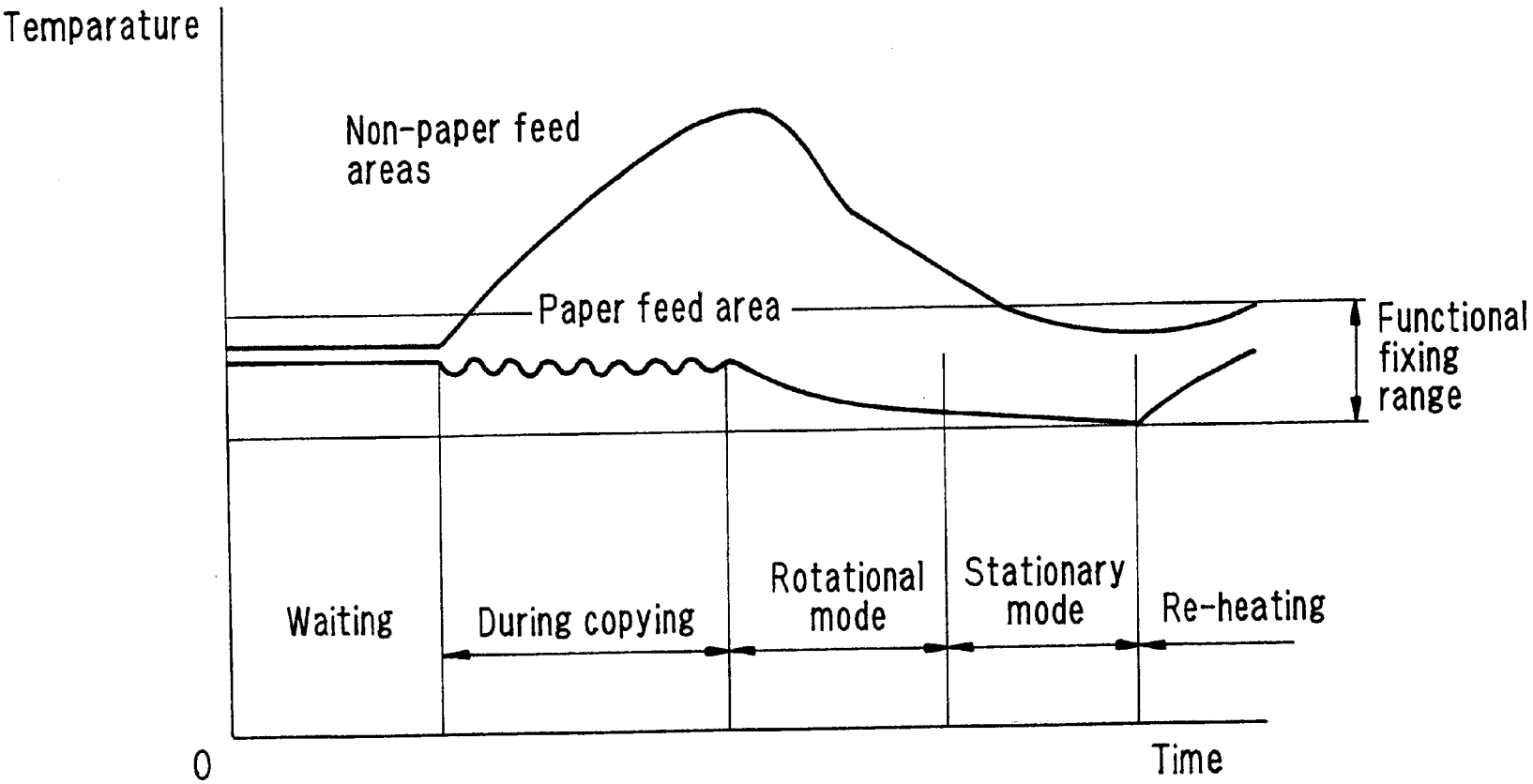
FIG. 1 is an illustrative view showing a control method of a heating device according to the present invention.

Controller 110 receives a paper size signal from a paper size detecting means when an image forming operation is started. If the paper size signal represents small-sized paper, as shown in FIG. 1 the paired rollers made up of heat roller 50 and pressing roller 60 continue to be rotated for a predetermined period (rotational mode) while no paper is allowed to pass, after the final sheet, of the consecutive printing operation of the same size, has passed through the heating device. The rotational mode is followed by the stationary mode in which the rollers are stopped from rotating for a predetermined period. The predetermined times may be set at 10 seconds for the rotational mode and 8 seconds for the stationary mode, for example.

Alternatively, if the paper size signal received from the paper size detecting means represents small-sized paper, controller 110 may make such a control that the paired roller made up of heat roller 50 and pressing roller 60 are stopped rotating for a predetermined period (stationary mode) while no paper is allowed to pass, after the final sheet, of the consecutive printing operation of the same size, has passed through the heating device. The stationary mode is followed by the rotational mode in which the rollers are driven for a predetermined period.

In this way, the predetermined periods and the order should not be limited to the above but can be selected as appropriate.

<Heat Source>

The embodiment of the heat source will be explained hereinbelow.

As the heat source of the heating device, the following devices can be used.

[Halogen Lamp . . . Lamp Heating System]

As shown in FIG. 2, as a halogen lamp 120 is energized, the filament made of tungsten emits light with a predetermined luminous distribution. The infrared is radiated from the filament and heats the inner peripheral side of heat roller 50.

[Heating Resistor . . . Direct Heating System]

As shown in FIG. 13, a heating element is formed by applying a heating layer (heating resistor 131) made up of a conductive material on an insulator surface. A current is supplied to this heating element, it generates heat following Joule's law.

Heating sheet 130 may be inserted within heat roller 50 or provided so as to cover the roller. Other than these, the heat sheet may be directly formed into metal core 51.

[Magnetic Field Generating Means . . . Induction Heating System]

As shown in FIG. 15, heat roller 50 as a heating element is formed of a conductive layer made of a material having a high relative permeability or a material having a high resistivity though a low relative permeability.

Then, a varying magnetic field is generated by magnetic field generating means 140 (induction coil) so as to induce eddy currents within the conductive layer to thereby generate heat.

As the heat source, three heating types, namely lamp heating system, direct heating system and induction heating system, have been described herein, however the heating system should not be limited to these. That is, other systems may be used or these systems can be also used in combination.

Next, the heating devices of the above heating systems will be described with heating control examples of their controllers.

(1) Lamp Heating System

The heating device of a lamp heating system is configured as shown in FIG. 2. That is, a halogen lamp 120 is disposed inside heat roller 50 so as to heat the heat roller 50. Each part of this heating device will be described next.

a) Heat Roller

Heat roller 50 is formed of metal core 51 with non-stick layer 52 on its outer periphery. Metal core 51 can be composed of iron (e.g., STKM12type), stainless steel (SUS304, SUS430, etc.), aluminum, copper and the like or alloys of these. The outside diameter, wall thickness, length, etc., of this metal core 51 can be selected depending on the specifications of the heating device, and the metal core can be formed in any shape.

Non-stick layer 52 may be formed of fluoro-compounds such as PFA (a copolymer of tetrafluoroethylene and perfluoroalkyl vinyl ether), PTFE (polytetrafluoroethylene), etc., silicone rubber, fluoro-rubber or the like.

Figure 3:
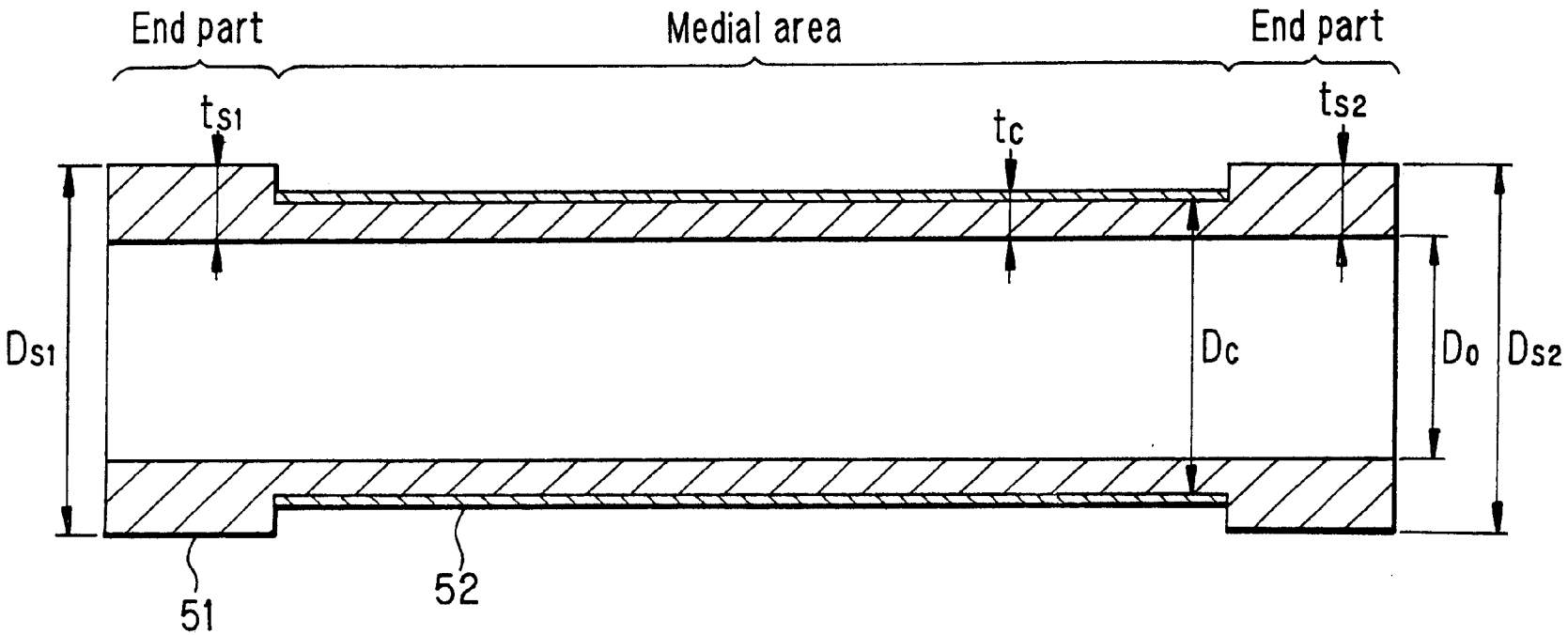
FIG. 3 is a diagram showing the schematic configuration of a heat roller used in a heating device according to the present invention.
Figure 4A:
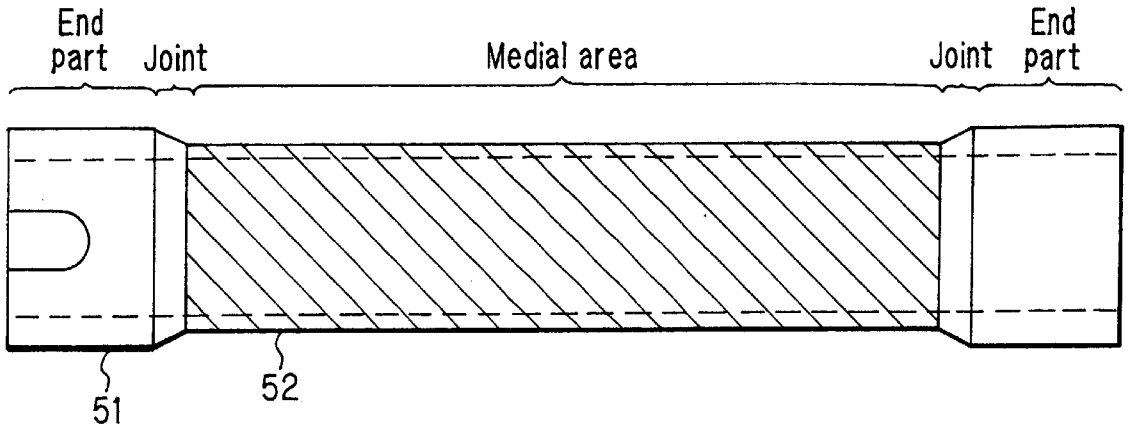
FIGS. 4A and 4B are illustrative views showing the shapes of the joint portions of joining the medial portion with both ends of heat rollers.
Figure 4B:
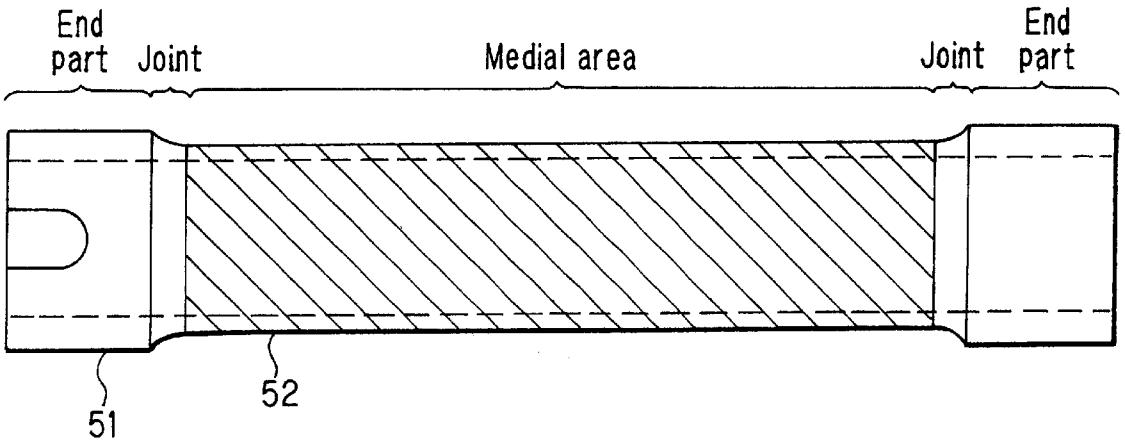
Figure 5:
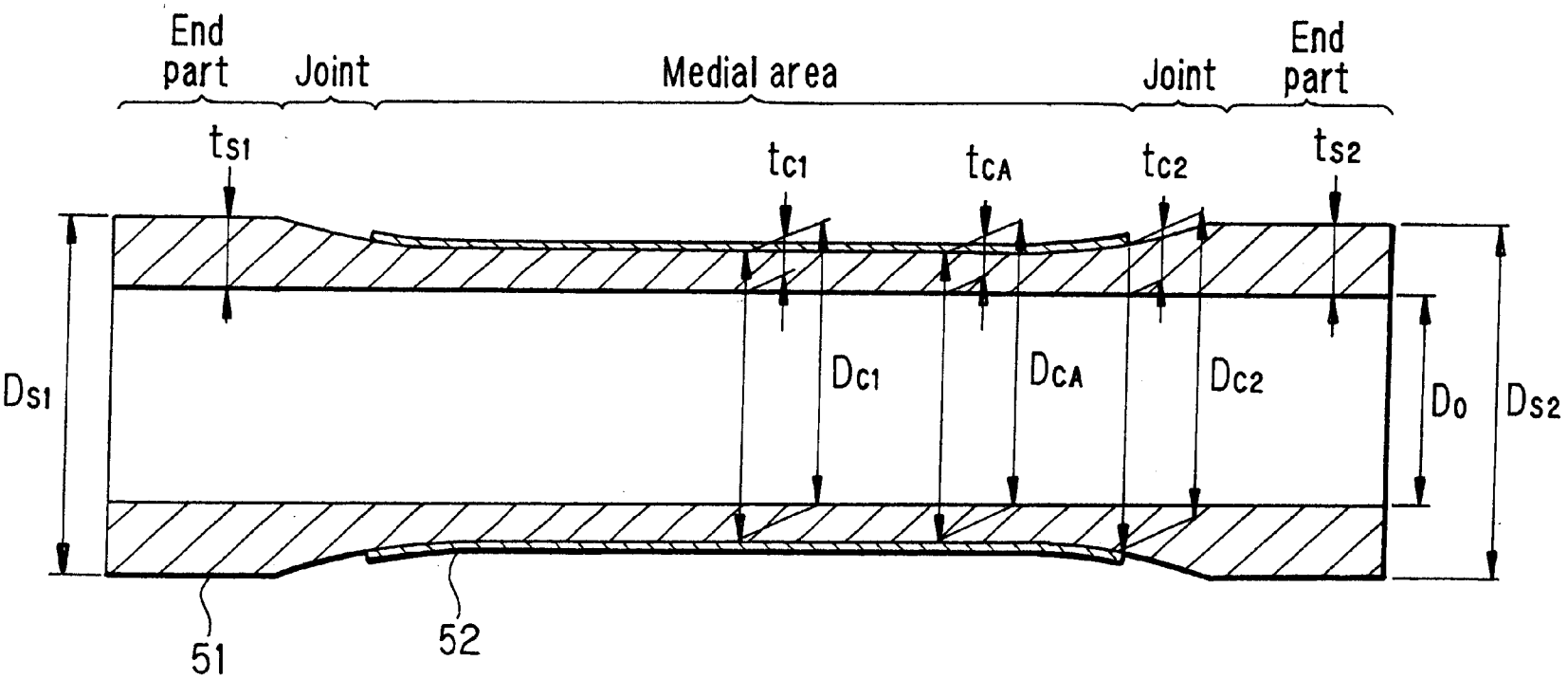
FIG. 5 is a diagram showing the schematic configuration of another heat roller used in a heating device according to the present invention.

This heat roller 50 may have shapes as shown in FIGS. 3 to 5.

(i) Heat Roller Having a Straight Cylinder Configuration in its Medial Portion:

The heat roller 50 shown in FIG. 3 is formed so that the end portions with respect to the roller length and the medial portion between the end portions have different wall thicknesses from one another. This heat roller 50 has an identical inside diameter over the full length, being formed with a non-stick layer 52 on the outer surface. The roller wall is formed to be thinner in the medial portion where printing paper passes through than at the end portions.

As shown in FIG. 3, heat roller 50 is formed such that, the full-length=347.8 mm, the wall thickness at both ends $t_{s1}=t_{s2}=0.5$ mm, the wall thickness in the medial portion $t_c=0.2$ mm, the inside diameter $D_0=39$ mm, the outside diameter at both ends $D_{s1}=D_{s2}=40$ mm, the outside diameter in the medial portion $D_c=39.4$ mm, the length of the medial portion=314.8 mm, the length at the driven end portion=21.5 mm and the length at the non-driven end portion=11.5 mm. It should be noted that these dimensions are not limited to the above values but can be selected as appropriate.

The end portions and the medial portion are 0.3 mm different in wall thickness (0.6 mm different in outside diameter). Joint portions are provided to join the medial portion with the end portions. These joint portions are formed in a stepped form.

The joint portions may be shaped as shown in FIGS. 4A and 4B, or in a tapered form (FIG. 4A) or in an arc form (FIG. 4B), other than the stepped form shown in FIG. 3. Metal core 51 of heat roller 50 maybe formed of a metal such as iron, stainless steel, aluminum, or alloys of these.

The metal core 51 of heat roller 50 has the section as stated above, and is coated with a surface treated layer (e.g., processed by parkerizing for rustproof when the roller is of an iron roller made up of STKM or the like) as an anti-corrosion measure. Further, in order for the inner surface to efficiently absorb radiated heat from halogen lamp 120, a heat-resistant heat-absorbing layer may be formed to be 20 to 30 $\mu$m thick by, for example, applying a mixture (Okitsumo, a trade name) of denatured silicone resins, inorganic heat resistant black pigments, hydrocarbons (solvent) and the like, and drying it.

After deposition of the aforementioned surface treatment, a primer layer (formed with a silicone adhesive or undercoating of 5 $\mu$m thick, for example) is applied beforehand in the area, on the outer peripheral surface, where non-stick layer 52 is to be formed, in order to improve adhesiveness between non-stick layer 52 and the surface treated layer. Then, non-stick layer 52 is formed on the primer. Non-stick layer 52 is formed with a film thickness of 20 $\mu$m. The film thickness of non-stick layer 52 is not limited to 20 $\mu$m, but can be selected as appropriate.

(ii) Heat Roller Having a Concave Barrel Shape in its Medial Portion:

The heat roller 50 shown in FIG. 5 is formed so that the end portions with respect to the roller length and the medial portion between the end portions have different wall thickness from one another. This heat roller 50 has an identical inside diameter over the full length, being formed with a non-stick layer 52 on the outer surface. The roller wall is formed to be thinner in the medial portion where printing paper passes through than at the end portions. The medial portion is formed of a concave barrel shape.

As shown in FIG. 5, heat roller 50 is formed such that, the full-length=267.5 mm, the wall thickness at both ends $t_{s1}=t_{s2}=0.3$ mm, the wall thickness in the medial portion $t_{CA}=0.2$ mm, the inside diameter $D_0=24.1$ mm, the outside diameter at both ends $D_{s1}=D_{s2}=24.7$ mm, the mean outside diameter in the medial portion $D_{CA}=24.5$ mm, the length of the medial portion=229 mm, the length of the driven end portion=21.5 mm and the length at the non-driven end portion=14 mm. It should be noted that these dimensions are not limited to the above values but can be selected as appropriate.

When the convex amount is assumed to be 0.05 mm, then $D_{C2}-D_{C1}=0.05$ mm and the wall thickness at the center and at the outer end in the medial portion are: $t_{C1}=0.2125$ mm and $t_{C2}=0.1875$ mm, respectively. The mean wall thickness of the medial portion can be represented by $t_{CA}=(t_{C1}+t_{C2})/2$.

The outside diameters at the center and at the outer ends in the medial portion are: $D_{C1}=D_0+2\cdot t_{C1}=24.525$ mm and $D_{C2}=D_0+2\cdot t_{C2}=24.475$ mm, respectively.

The end portions and the medial portion are 0.1 mm different in wall thickness (0.2 mm different in outside diameter). So, joint portions of 1.5 mm long are provided to join the medial portion with the end portions. These joint portions are formed in a tapered form as shown in FIG. 4A.

Metal core 51 of heat roller 50 may be formed of a metal such as iron, stainless steel, aluminum, or alloys of these.

The metal core 51 of heat roller 50 has the section as stated above, and is coated with a surface treated layer to prevent corrosion and the like. Further, in order for the inner surface to efficiently absorb radiated heat from halogen lamp 120, a heat-resistant heat-absorbing layer may be formed.

After deposition of the aforementioned surface treatment, a primer layer is formed beforehand in the area, on the outer peripheral surface, where non-stick layer 52 is to be formed, in order to improve adhesiveness between non-stick layer 52 and the surface treated layer. Then, non-stick layer 52 is formed on the primer. Non-stick layer 52 is formed as a film layer having a thickness of 20 $\mu$m, for example. The film thickness of non-stick layer 52 is not limited to 20 $\mu$m, but can be selected as appropriate.

Though description herein was made referring to heat roller 50 and pressing roller 60 of cylindrical shapes, the present invention can be applied to cases where the heating element and pressing element have a belt-like configuration or a film-like configuration. In such a case, controller 110 should be modified considering the materials, structures and belt perimeters of the heating element and/or pressing element, so that the present invention can be applied thereto. Further, the present invention can be applied to a case where a resistance heater 131, which will be explained hereinbelow in the description of the direct heating system, is used instead of the heater lamp so that the heat source is put into contact with the obverse surfaces or inner surfaces of the heating element and pressing element to directly heat these elements.

b) Pressing Roller

Pressing roller 60 is formed of metal core 61 made of iron, stainless steel or aluminum, with a heat-resistant elastic layer made of silicone rubber or the like. A non-stick layer 62 may be formed on the surface of pressing roller 60. This pressing roller 60 is pressed against heat roller 50 with a force of 100 N by means of unillustrated elastic devices (springs), whereby a contact nip 70 of about 2 to 8 mm wide is formed between pressing roller 60 and heat roller 50.

For example, a metal core 61 may be a stepped stainless steel bar of 10 mm in diameter and 264 mm long, and a heat-resistant elastic layer may be a silicone rubber molding, which has been formed by injection molding so as to have a diameter of 23 mm with 223.5 mm in length and 6.5 mm in thickness. As another example, a metal core 61 may be a stepped stainless steel bar of 20 mm in diameter and 332 mm long and a heat-resistant elastic layer may be a solid or sponge-like elastic layer of 29.9 mm in diameter, 310 mm long and 5 mm thick, coated with a PFA tube having a film thickness of 50 $\mu$m.

It should be noted that the pressing force of pressing roller 60 against heat roller 50 is not limited to the above value but can be set optimally depending on the configuration of the paired rollers, the fixing conditions and the like. Also the contact nip 70 formed by this abutment should not be limited to the above value, but can be set as appropriate, though it is usually set between about 2 mm to 7 mm.

c) Halogen Lamp

Halogen lamp 120 as a heat source may be a single lamp having a heating power of 800 W or 1000 W, or may be formed of two lamps having heating powers of 550 W and 350W. Halogen lamp 120 should not be limited to these, but any halogen lamp of a desired luminous distribution and heating power can be selected appropriately.

The halogen lamp 120 used here is that in which a tungsten filament is put inside a glass tube of 6 mm or 8 mm in diameter, with a halogen inert gas charged and sealed therein.

d) Controller

FIG. 6 shows an example of controller 110.

As shown in FIG. 6, controller 110 is composed of a microcomputer including a CPU 111, ROM 112, RAM 113 and other circuits.

CPU 111 includes a processing unit 114, internal memory 115, input port 116 and output port 117. Connected to input port 116 are a paper cassette size sensor 200, manual feed tray size sensor 210, paper feed sensor 220, separation detector 230, paper discharge sensor 240, thermistor 100, etc.

CPU 111 receives the sensor signals through input port 116 and compares the voltage signal from thermistor 100 with the set voltage corresponding to the set temperature in order to achieve the predetermined temperature which has been set beforehand. Then, the CPU outputs a lamp control signal to a lamp driver 250 via output port 117 so as to implement on/off control of halogen lamp 120. Based on the input sensor statuses, the CPU outputs motor drive signals at suitable timings to a motor driver 260 so as to cause a drive motor 270 to rotate and stop. Correlation between the set voltage and the set temperature can be made based on a temperature-voltage conversion table stored in ROM 112, for example.

Controller 110 also has the function of controlling the rotational drives of the paired rollers of heat roller 50 and pressing roller 60, in addition to the temperature control function of heat roller 50 or pressing roller 60. Specifically, controller 110 sends paired roller drive signals to drive motor 270 so as to control rotation and stoppage of the paired rollers as well as to control the rotational speed of the paired rollers.

Further, in addition to the aforementioned temperature control function and rotational drive control function, this controller 110 receives the detected signal from a detecting means for detecting the paper conveyance status and makes temperature control and rotational drive control in accordance with the conveyance of the printing paper.

Figure 7A:
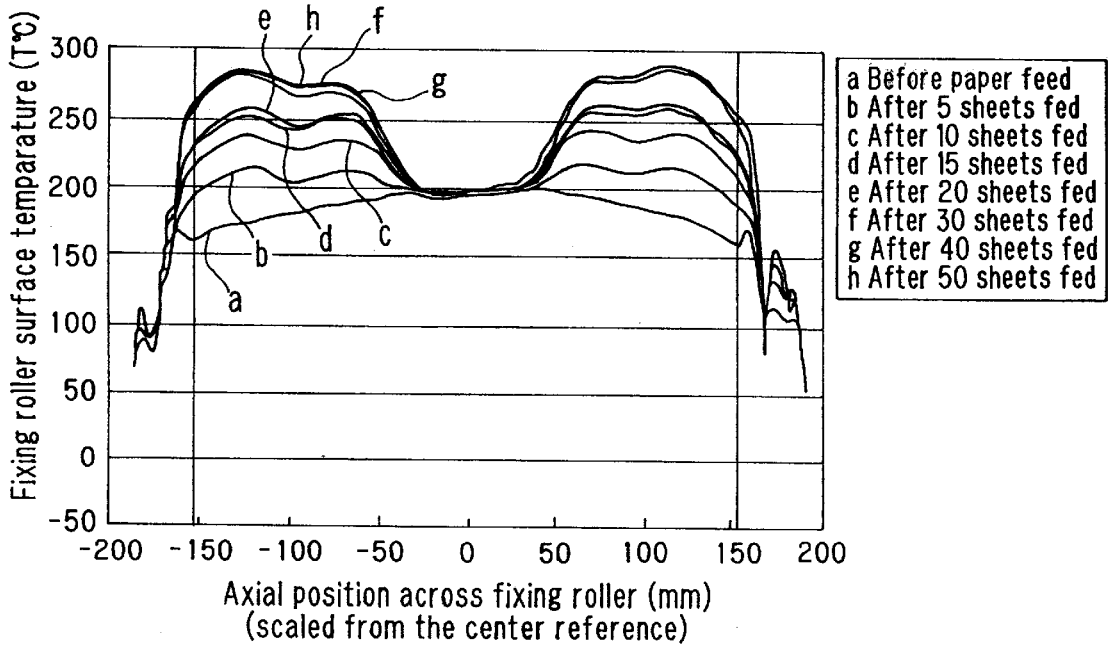
FIGS. 7A and 7B are charts for explaining the overheated states of the non-paper feed areas of a heat roller.
Figure 7B:
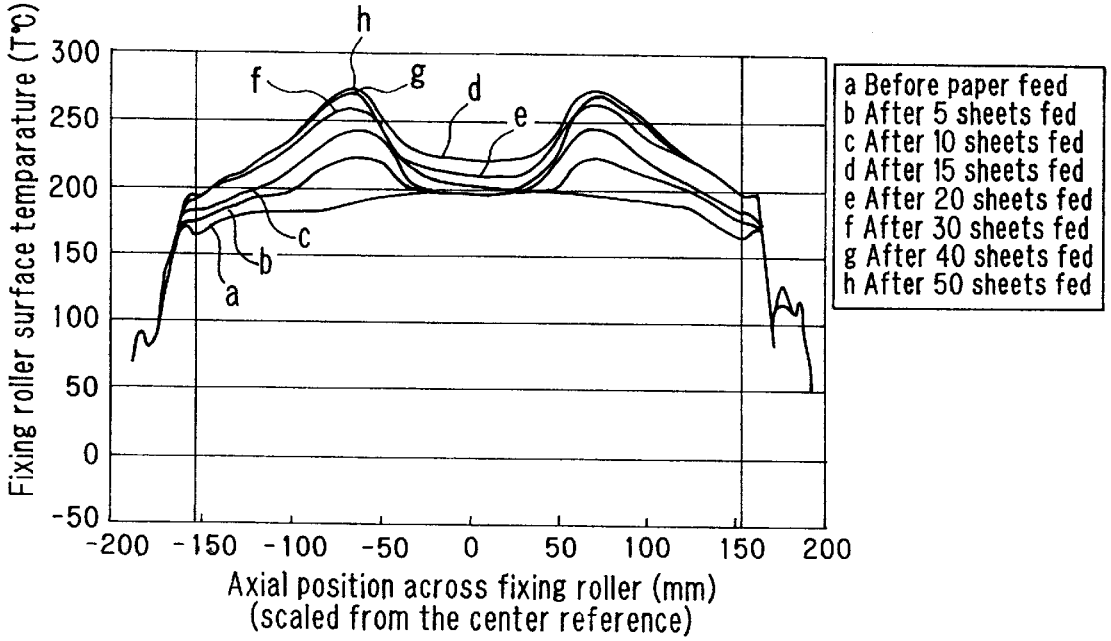

When operations of small-sized paper are implemented, the temperature of heat roller 50 increases at the non-paper feed areas as the number of sheets consecutively having passed therethrough increases, as shown in FIGS. 7A and 7B. In this case, the temperature at the non-paper feed areas will reach 260 to 270° C. or higher.

This controller 110 has the function of lowering the overheated state of heat roller 50 to the temperature range in which fixing is permitted, other than the temperature control and drive control during normal copying operations.

Figure 8A:
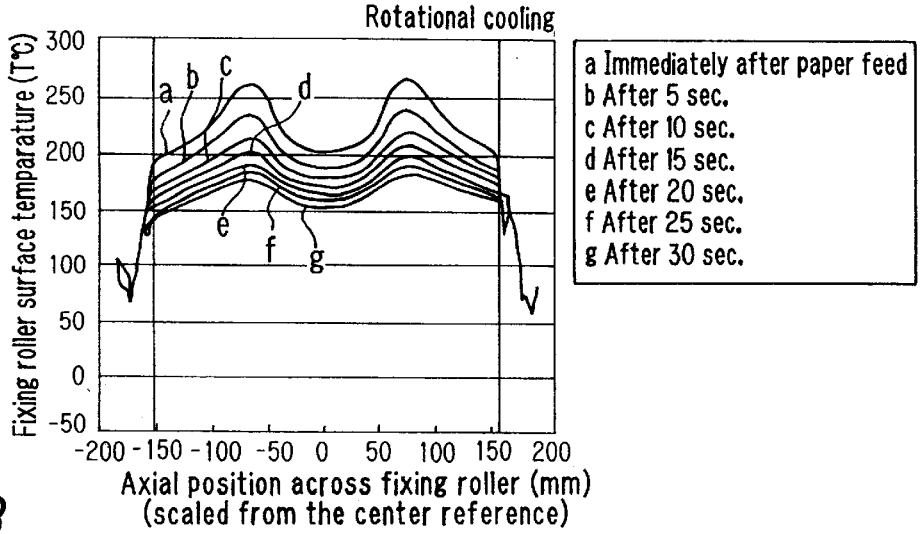
FIGS. 8A, 8B and 8C are comparative charts showing temperature drops according to a control method of the present invention, FIG. 8A showing the axial temperature distribution in the rotational mode, FIG. 8B showing the axial temperature distribution in the stationary mode.
Figure 8B:
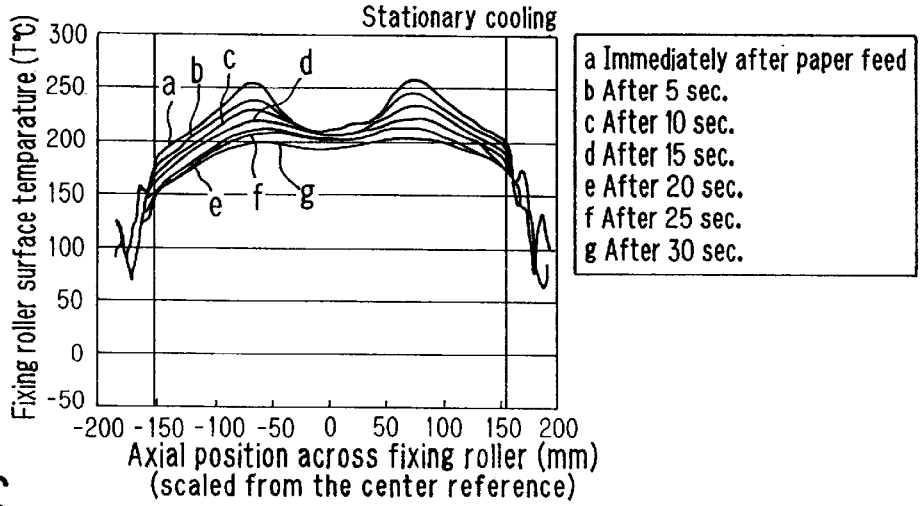
Figure 8C:
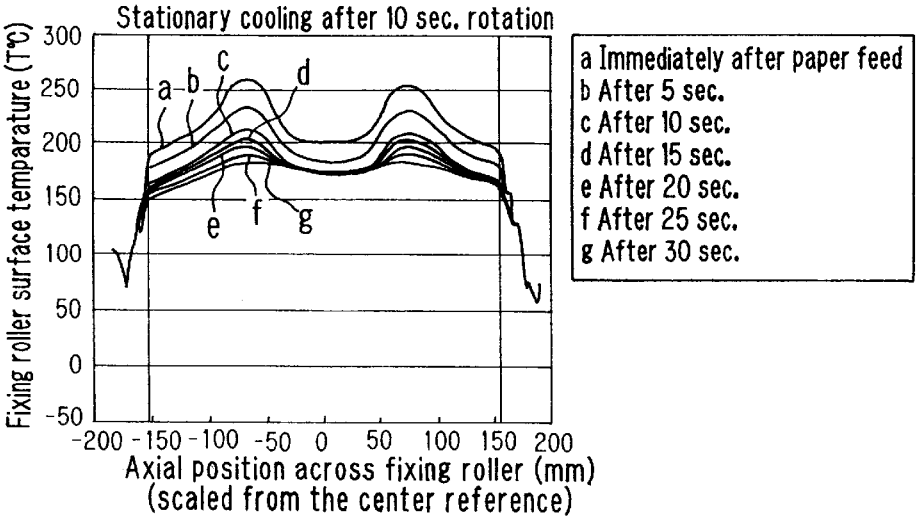

FIGS. 8A, 8B and 8C are illustrative charts for illustrating how the surface temperature at the non-paper feed areas changes from the overheated state after postcard-sized paper as small-sized paper has passed therethrough, by plotting the time-dependent temperature distributions, scaled from the center of the roller as a reference point.

When the roller was cooled in the rotational mode alone, the surface temperature of the heat roller 50 lowered to 200 to 210° C. and the temperature variation decreased to about 35° C. after 20 seconds elapsed from the start of cooling, as shown in FIG. 8A.

When the roller was cooled in the stationary mode alone, the surface temperature of the heat roller 50 lowered to 210° C. and the temperature variation decreased to about 15° C. after 20 seconds elapsed from the start of cooling, as shown in FIG. 8B.

In contrast to the above, when the roller was cooled for 10 seconds in the rotational mode and 8 seconds in the stationary mode, the surface temperature of the heat roller 50 could be lowered to 195° C. with the temperature variation decreased to about 20° C., as shown in FIG. 8C.

Figure 9A:
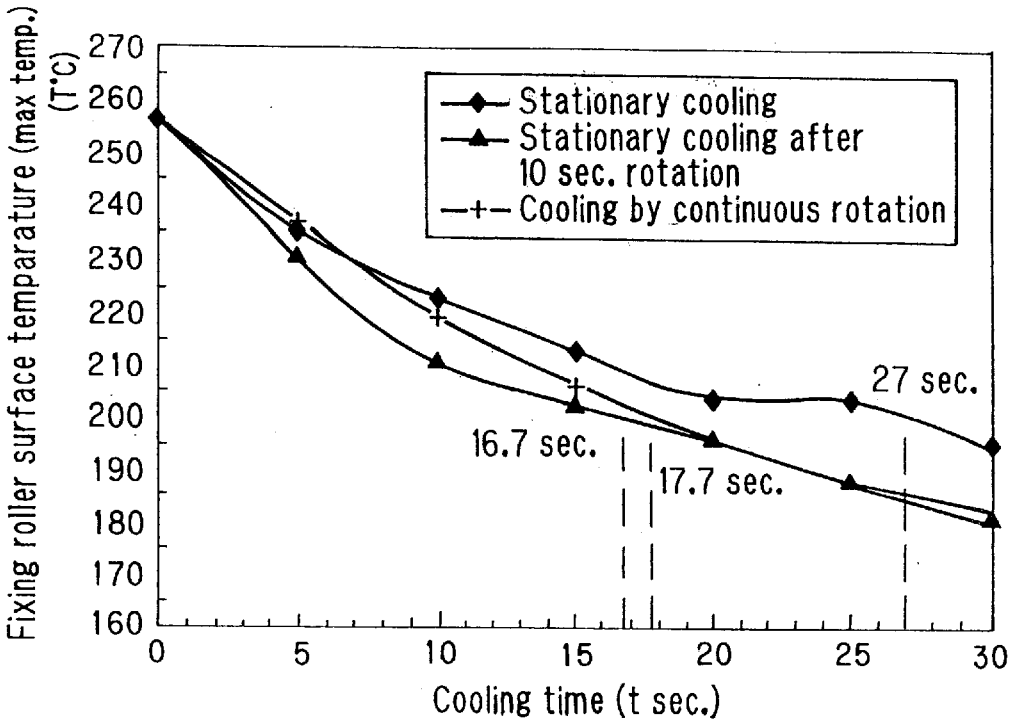
FIGS. 9A and 9B are charts showing temperature drops according to a control method of the present invention, FIG. 9A showing the temperature drops of the maximum temperature in the non-paper feed areas on the heat roller surface, FIG. 9B showing the reductions of the differential temperature between the paper feed area and the non-paper feed areas.
Figure 9B:
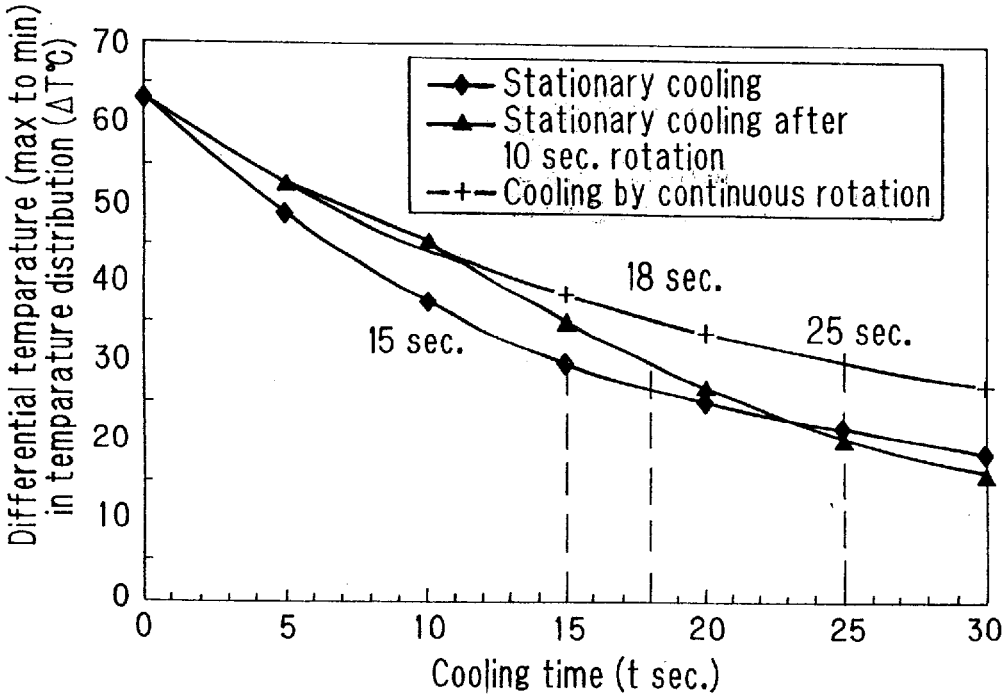

FIGS. 9A and 9B are illustrative charts showing the surface temperature (maximum temperature) of the heat roller across the length-wise temperature distribution and the temperature difference between the paper feed area and the non-paper feed areas, with respect to the elapsed time, based on the measurement results shown in FIGS. 8A, 8B and 8C.

As understood from FIGS. 9A and 9B, observation of the surface temperature (maximum temperature) of heat roller 50 and the temperature difference between the paper feed area and the non-paper feed areas shows that when cooling was performed in the rotational mode alone, the maximum temperature decreased quickly but tended to take a longer time to reduce the temperature difference.

When cooling was performed in the stationary mode alone, the temperature difference tended to be reduced quickly but the maximum temperature could not be lowered so quickly as in the rotational mode.

In contrast, when cooling was performed successively in the rotational mode and in the stationary mode, both the maximum temperature and the temperature difference could be reduced faster than when each mode was implemented individually, owing to the combined effect.

In this way, when sheets of small-size paper are passed through consecutively, it is possible to quickly reduce the surface temperatures of heat roller 50 and pressing roller 60, by controlling motor driver 260 for driving the paired rollers etc., or controlling the rotation of the paired rollers whilst controlling the operational state of halogen lamp 120, after the final sheet of paper has passed through.

Controller 110 is adapted to be able to change the drive speed of the paired rollers based on the paper size, elapsed time and other timings. In this case, increase in rotational speed of the paired rollers makes it possible to enhance the temperature drop rate, so that the surface temperature can be restored more quickly to the functional fixing range. Further, the controller is also adapted to be able to control the heating operation of halogen lamp 120, based on the paper size, elapsed time and other timings.

Figure 10:
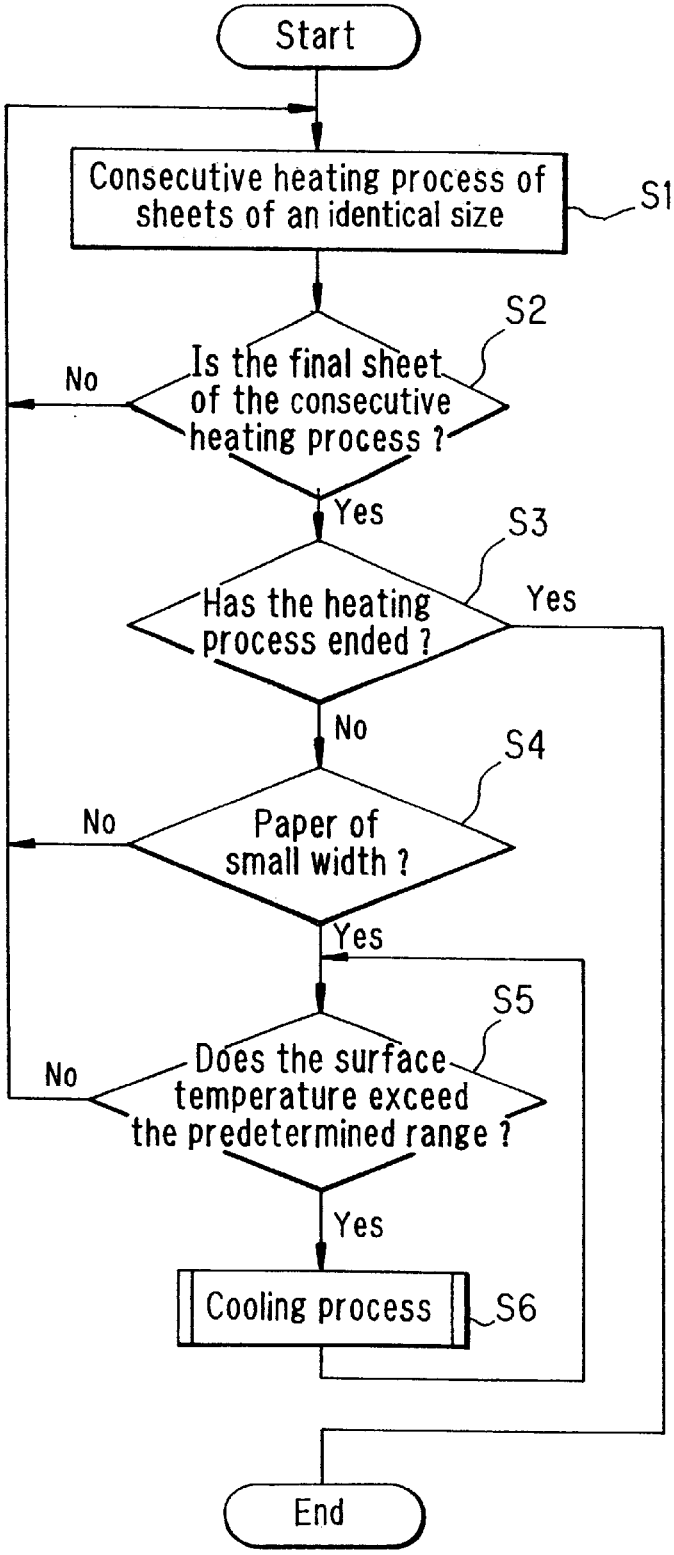
FIG. 10 is a flowchart showing an example of a processing sequence of a heating device.
Figure 11:
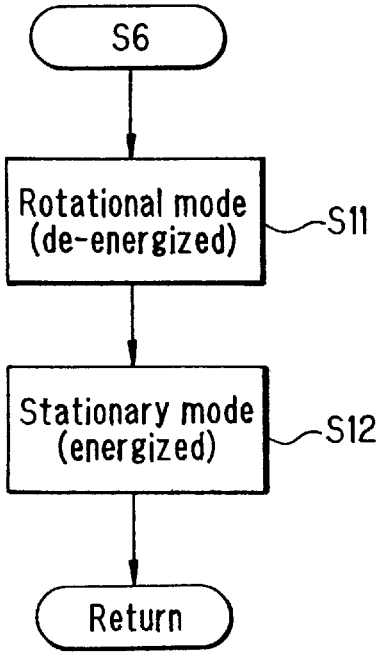
FIG. 11 is a flowchart showing an example of a cooling process.

Based on the above investigation, an example of the control sequence of the heating device of the present invention will be described. FIG. 10 is a flowchart showing one example of the process of the heating device. FIG. 11 is a flowchart showing one example of the cooling process.

At Step S1, sheets of an identical size are being successively heat-processed through the heating device. CPU 111 of controller 110 shown in FIG. 6, based on the information from a paper feed sensor 220, determines whether the currently processed sheet is the final sheet of the consecutive job (Step S2). If it is not the final one, the operation returns to Step S1. If it is the last sheet, the CPU determines whether the heating process should be finished with this step (Step S3). If a further heating process session follows, CPU 111 determines whether the paper having been used for the previous consecutive heat process is of a small-width size, based on the detection result from paper cassette size sensor 200 or from a manual feed tray size sensor 210 (Step S4). If the paper previously used is not paper of a small-width size, the operation returns to Step S1. If the paper previously used is of a small-width size, the operation goes to Step S5. CPU 111 judges from the detection result of thermistor 100 whether the surface temperature of heat roller 50 falls within the functional fixing range shown in FIG. 1 (Step S5). When the surface temperature of heat roller 50 exceeds the functional fixing range, a cooling process is implemented (Step S6), whereas the operation returns to Step S1 if the surface temperature falls within the functional fixing range.

Next, the cooling process will be described.

As shown in FIG. 11, CPU 111 implements the rotational mode in which heat roller 50 and pressing roller 60 are rotated for a predetermined period while the halogen lamp is deactivated (Step S11). Specifically, a motor drive signal for causing the drive motor to rotate heat roller 50 and pressing roller 60 is output to motor driver 260 from output port 117. CPU 111 also outputs lamp control signals HLC1 and HLC2 for turning off halogen lamps HL1 and HL2 to lamp driver 250 from output port 117. In this way, by keeping the halogen lamps de-energized, the temperature drop rate can be enhanced, hence the surface temperature can be reduced quickly to the predetermined temperature range.

Next, CPU 111 implements the stationary mode in which heat roller 50 and pressing roller 60 are kept still for a predetermined period of time while the halogen lamps are energized (Step S12). Specifically, a motor drive signal for stopping the drive motor is output to motor driver 260 from output port 117. CPU 111 also outputs lamp control signals HLC1 and HLC2 for turning on halogen lamps HL1 and HL2 to lamp driver 250 from output port 117. In this way, by heating the roller in advance in preparation for the next heating process, it is possible to quickly set the heating process at the standby.

Figure 12:
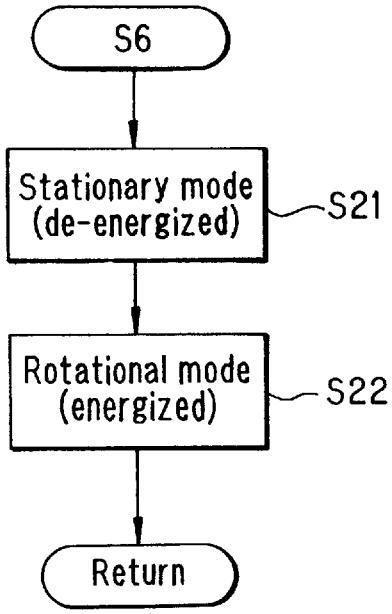
FIG. 12 is a flowchart showing another example of a cooling process.

Next, FIG. 12 shows another example of a cooling process.

CPU 111 implements the stationary mode in which heat roller 50 and pressing roller 60 are kept still for a predetermined period of time while the halogen lamps are deactivated (Step S21). Thereafter, CPU 111 implements the rotational mode in which heat roller 50 and pressing roller 60 are rotated for a predetermined period while the halogen lamp is activated (Step S22).

In this way, the rotational mode and stationary mode are implemented in combination. In this case, the deactivation of the halogen lamps may be carried out with either mode. As in the flowcharts shown in FIGS. 11 and 12, when the halogen lamps are de-energized in the first half mode and energized in the second half mode, this is effective in warming up the heat roller in preparation for the next heating process. Alternatively, when the surface temperature is too high, the halogen lamps may be deactivated in both modes.

(2) Direct Heating System

In a direct heating system, as shown in FIG. 13, a heating sheet 130 is arranged inside heat roller 50 so as to heat the heat roller 50.

a) Heat Roller

Heat roller 50 is formed of a metal core 51 with a non-stick layer 52 on its outer periphery. In addition, heating sheet 130 comprised of a resistance heater 131 and a heat-resistant insulative element 132 is provided on the inner periphery of metal core 51. With concern to the metal core 51 and non-stick layer 52, the same configuration as those of the heat roller 50 used in the lamp heating system is employed.

b) Heating Sheet

Figure 14:
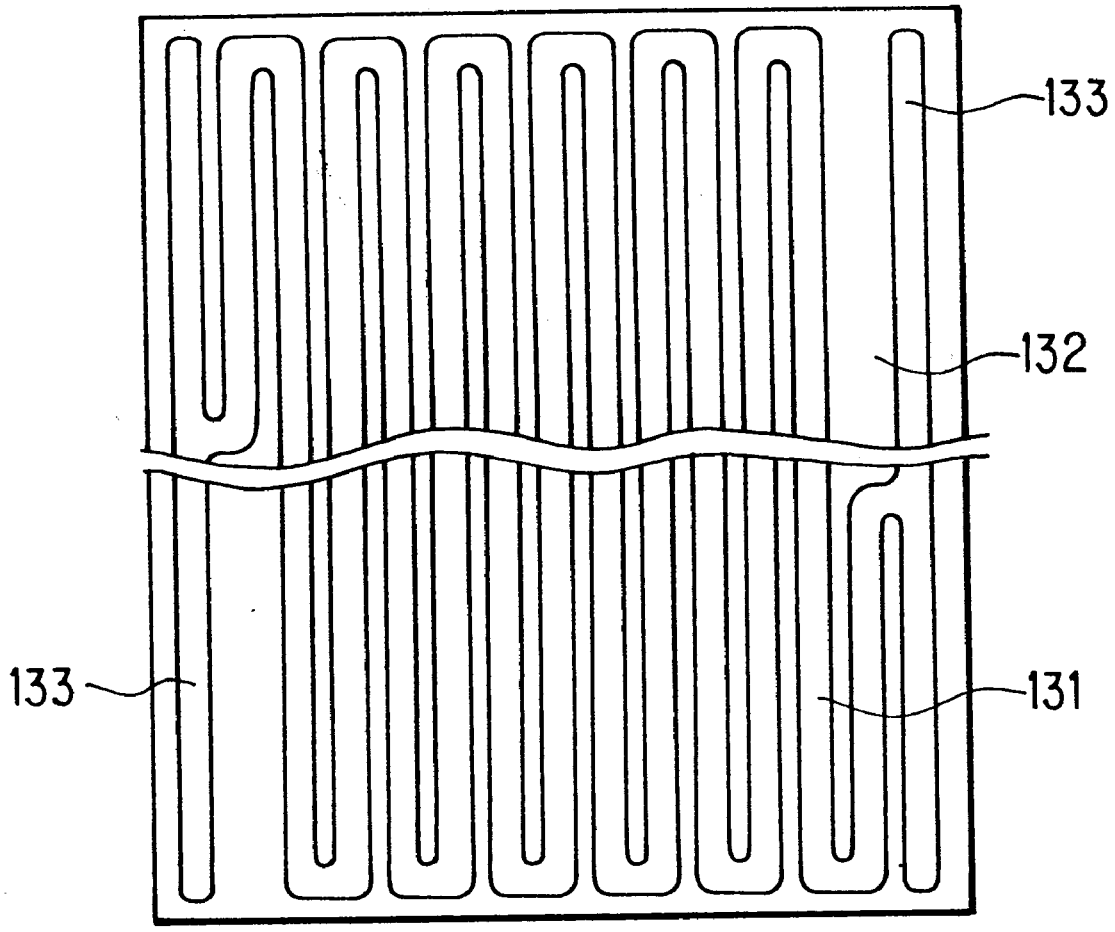
FIG. 14 is a diagram showing the schematic configuration of a heat-generating sheet for a heat roller.

Heating sheet 130 is arranged on the inner surface of metal core 51 of heat roller 50, as shown in FIG. 13. This heating sheet 130 is comprised of heat-resistant insulative element 132 arranged in contact with the inner peripheral surface of core metal 51 and a resistance heater 131 arranged on the inner peripheral surface of the heat-resistant insulative element 132, as shown in FIGS. 13 and 14.

Further, in order to supply electric current to resistance heater 131, receiving portions 133 made up of a copper alloy such as phosphor bronze are formed at both ends of heat roller 50. These receiving portions 133 are electrically connected to resistance heater 131. As resistance heater 131 is energized through the receiving portions 133, resistance heater 131 heats so that heat roller 50 is heated to a predetermined temperature.

The heating sheet 130 arranged inside heat roller 50 is formed with resistance heater 131 laid out rectangularly in a zigzag pattern across the whole area of heat-resistant insulative element 132. Though the heat roller described here employs heating sheet 130, the same function can be also achieved by forming heat-resistant insulative layer 132 on the inner surface of metal core 51, forming resistance heater layer 131 thereon and patterning the resistance heater layer by laser beams etc., to adjust the resistance. Further, the disposition of heating sheet 130 should not be limited to the inner side of the heat roller, but resistance heater 131 may be arranged on the outer peripheral surface. The pattern of resistance heater 131 should not be limited to the rectangular zigzag pattern but any other pattern can be used as long as it can uniformly heat the heat roller 50.

Heat-resistant insulative element 132 is usually formed of a sheet-like element made up of polyimide. But any material other than polyimide can be used as long as it is an insulator having heat resistance. Usually in such configuration described above, as the material for resistance heater 131, such materials as stainless steel foils, Ni—Cr type alloys, Fe—Cr—Al type alloys, refractory metals (such as Pt, Mo, Ta, W, etc.), etc. are preferably used. However, metallic resistor made of copper, etc., can also be used. Furthermore, some of non-metallic materials such as silicon carbide, molybdenum silicide, carbon, etc. may be used.

C) Resistance Heater

Resistance heater 131 is specified to have a heating power of about 1000 W. The resistance heater may employ the following materials in (1) to (6).

(1) Resistance heater made from a metal paste of silver-palladium alloys, silver-platinum alloys, or a metal paste mainly including these alloys.

(2) Oxide ceramics mainly composed of barium titanate (merchandized as PTC (Positive Temperature Coefficient) heater).

(3) Conductive ceramic which is produced by blending carbides (silicon carbides) or oxides (zirconia: $ZrO_2$, alumina: $Al_2O_3$) with conductive materials such as gold, sliver, copper, platinum, nickel, aluminum and the like and sintering it.

(4) Semiconductive ceramic which is produced by adding oxides of lanthanum, yttrium, etc. as dopant to oxides (zirconia: $ZrO_2$, alumina: $Al_2O_3$).

(5) Molding formed by heat-molding a prepreg sheet of 0.01 to 0.5 mm thick, made up of a carbon fabric substrate impregnated with a heat-resistant resin such as polyimide resin, bismaleimide resin, phenol resin, etc., in a predetermined ratio.

(6) Metallic resistance heater made of stainless steel, Ni—Cr type alloys, Fe—Cr—Al type alloys, refractory metals (such as Pt, Mo Ta, W, etc.), etc.

Furthermore, besides the materials described above, any material can be used as long as it possesses heating characteristics.

As to shape of the resistance heater, it may take sheet or film shape, rod shape, string or filament shape, or any other shape, and should not be limited to the shapes exemplified above.

d) Pressing Roller

The same configuration as the pressing roller 60 used in the above-described lamp heating system is employed.

e) Controller

Almost the same configuration as the controller 110 used in the above-described lamp heating system is employed.

In the temperature control of controller 110, resistance heater 131 is controlled as the heat source instead of halogen lamps 120. Therefore, lamp driver 250 shown in FIG. 6 is replaced by a heater driver so as to be able to drive resistance heater 131.

The rotational drive control function has the same configuration as that of controller 110 of the above-described lamp heating system.

(3) Induction Heating System

In an induction heating system, a heat roller 50 is configured of a metal core 51 of a conductive layer and a non-stick layer 52 formed on its outer periphery while a magnetic field generating means 140 is arranged around the roller, as shown in FIG. 15.

a) Heat Roller

For the conductive layer of heat roller 50, a conductor having a high relative permeability is preferred. Preferred examples include iron, magnetic stainless steel (SUS430, etc.), silicon steel sheet, electrical steel sheet, nickel steel and the like. Materials which present a low relative permeability but have a high resistivity (e.g., non-magnetic stainless steel: SUS304 etc.) may be used as long as they can generate a high heating power from eddy currents. Alternatively, the heat roller may be configured so that the above material having a high relative permeability is laid on a non-magnetic base member (e.g., ceramics, etc.) so as to present conductivity.

Non-stick layer 52 has the same configuration as that of heat roller 50 in the above-described lamp heating system.

b) Magnetic Field Generating Means (Induction Coil)

Figure 16:
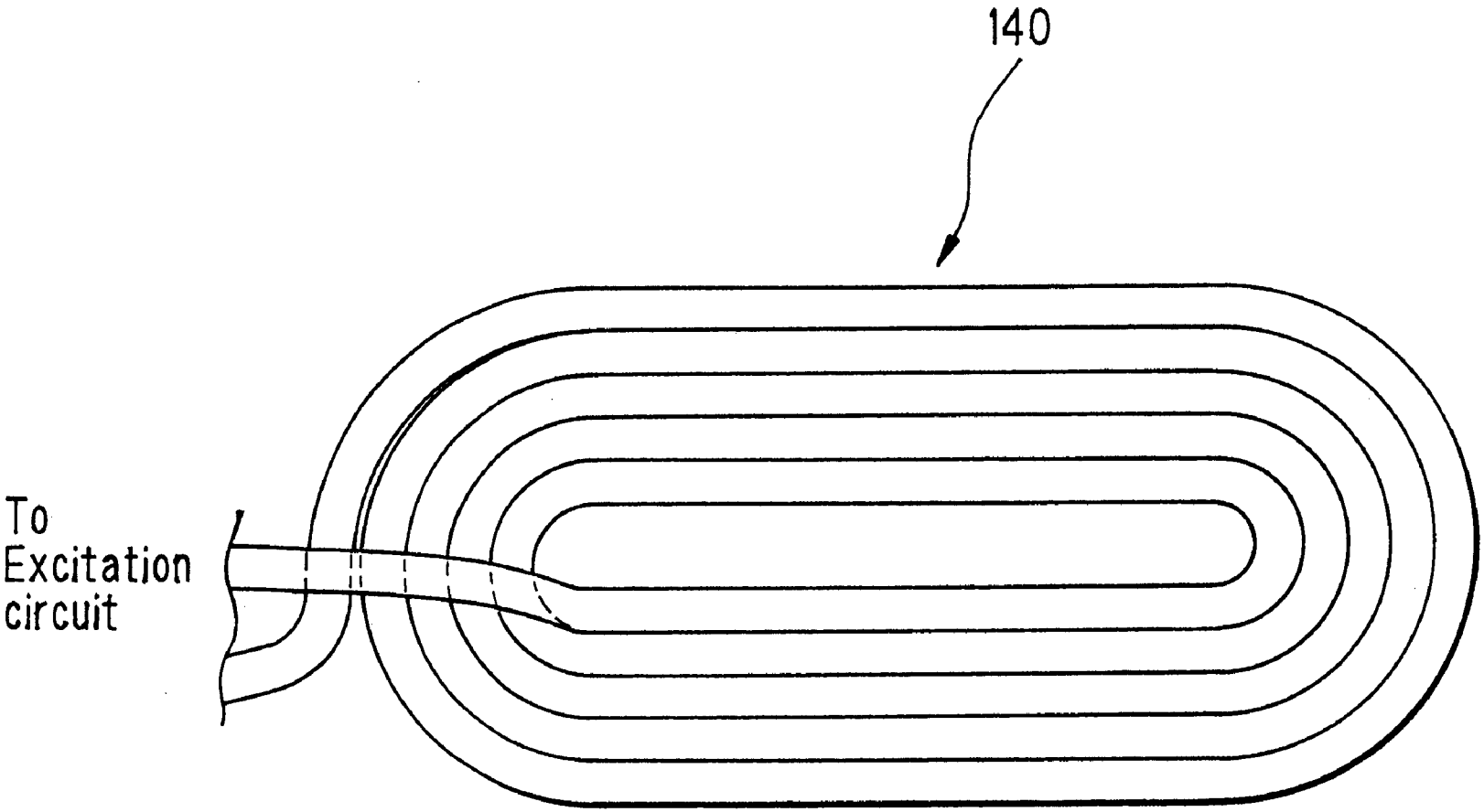
FIG. 16 is an illustrative view showing the shape of a induction coil of a fixing unit using an induction heating system.

The magnetic field generating means is comprised of an induction coil 140 as shown in FIG. 16 and can heat the heat roller 50 by eddy currents. As induction coil 140 is arranged outside heat roller 50 as shown in FIG. 15, magnetic fluxes concentrate towards the center of induction coil 140 because of its curvature so that strong eddy currents can be generated. When a material having a high permeability is used for heat roller 50, it is possible to enhance the heating efficiency since a further concentration of magnetic fluxes can be expected.

The configuration of this induction coil 140 will be described next.

Induction coil 140 employs an aluminum solid wire (covered with a surface insulating layer (e.g., oxide film)), taking heat resistance into account. However, copper wire, copper-based wire of combined materials may be used. It is also possible to use a litz wire (a wire formed of stranded enamel wires etc.). Whichever wire is selected, in order to reduce the joule loss within the coil, the total resistance of the induction coil may and should be 0.5 Ω or less, preferably 0.1 Ω or less. In the configuration of induction coil 140 shown in FIG. 15, a single coil is arranged across the length of heat roller 50, but a multiple number of coils may be laid out depending on the sizes of recording paper 90 to be fixed.

Figure 17A:
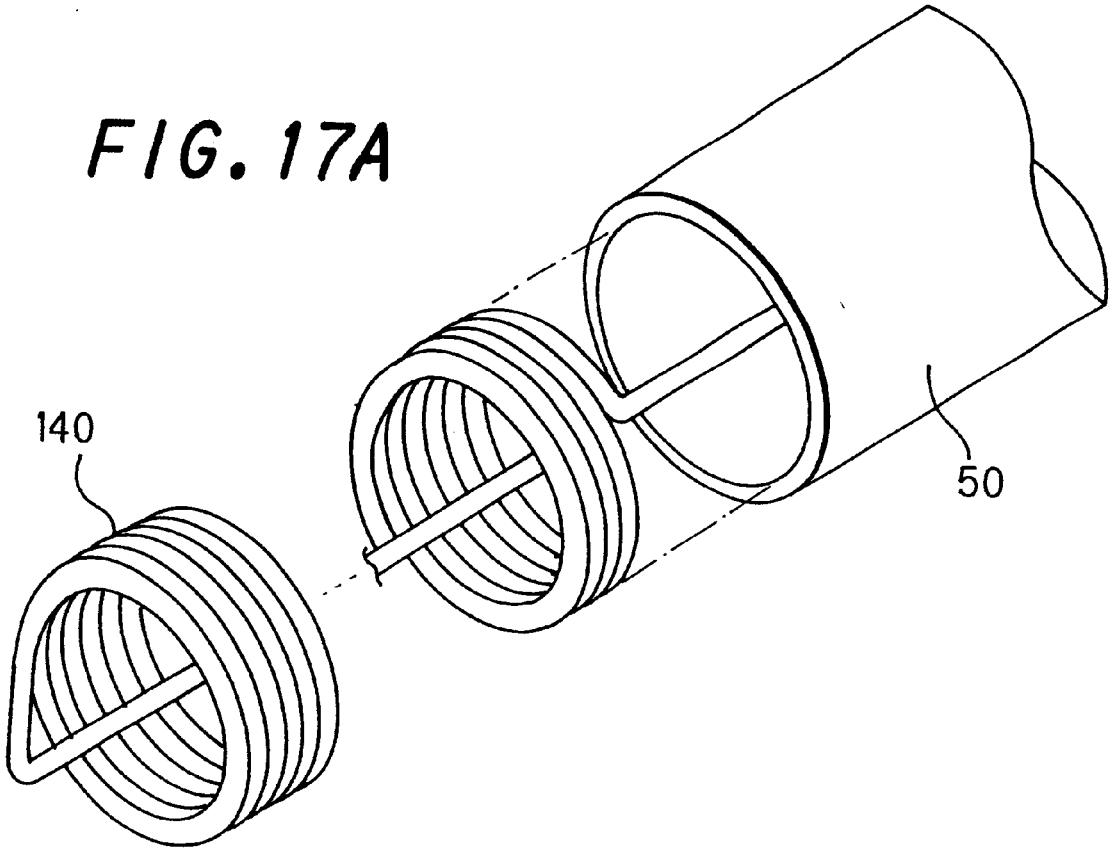
FIGS. 17A and 17B are illustrative views showing variational shapes of induction coils.
Figure 17B:
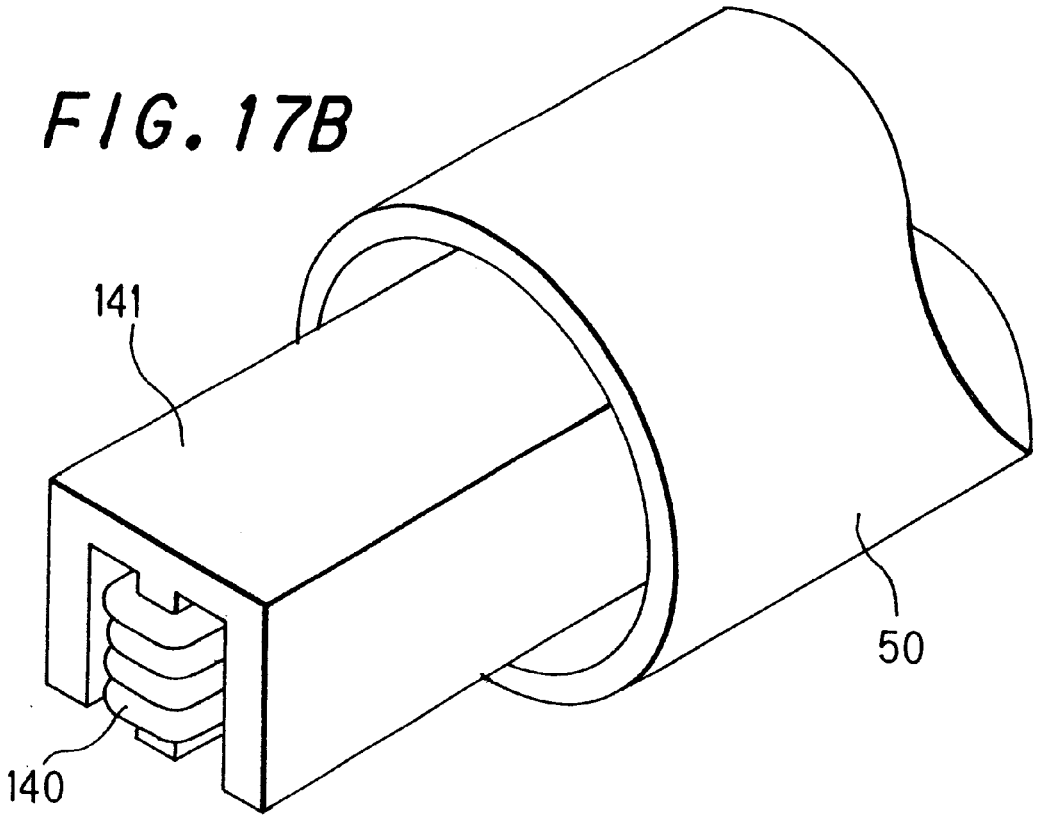

Instead of placing induction coil 140 outside heat roller 50, an induction coil configured as shown in FIG. 17A or 17B may be arranged inside heat roller 50. Specifically, induction coil 140 of a helical type may be formed as shown in FIG. 17A; or induction coil 140 may be formed by providing multiple windings of a wire on a highly-permeable ferrite core 141 along its length, as shown in FIG. 17B.

c) Pressing Roller

The pressing roller 60 has the same configuration as that used in the above-described lamp heating system.

d) Controller

The controller 110 has almost the same configuration as that used in the above-described lamp heating system. In the temperature control of controller 110, the induction coil is controlled as the heat source instead of halogen lamps 120. For halogen lamps 120 and resistance heater 131 commercial a.c. power supply is turned on and off using switching elements, but for the induction coil a high-frequency alternating current is needed. Therefore, lamp driver 250 shown in FIG. 6 needs to be replaced by a component for supplying high-frequency current.

The rotational drive control function has the same configuration as that of controller 110 of the above-described lamp heating system.

e) Fixing Unit

Next, the fixing operation in the fixing unit will be described.

Upon the warm-up for the fixing operation, the excitation circuit connected to the induction coil is turned on so that induction coil 140 is excited, eddy currents are induced within the conductive portion of heat roller 50 to generate heat following Joule's law.

The heating power in this embodiment is about 1000 W. When energized from the power source, heat roller 50 starts rotating and pressing roller 60 also rotates following the heat roller. The surface temperature of heat roller 50 is constantly detected by means of a temperature detecting means (e.g., a thermistor 100). When the surface temperature of heat roller 50 reaches a predetermined temperature (e.g., 190° C.), the warm-up completes. Then, power supply to induction coil 140 through the excitation circuit is changed into the ON/OFF control mode so that the surface temperature of heat roller 50 will be kept at the predetermined temperature.

Next, a recording sheet 90 (element to be heated) with an unfixed toner image transferred thereon is fed into the contact nip 70, the toner image is fused and fixed by heat from heat roller 50 and pressing by pressing roller 60, whereby a fixed stable image is formed on the recording paper 90.

It should be noted that the temperature control method is not limited to ON/OFF control, but other control methods such as phase control and cycle control can be employed.

Next, another example of a heating control method using a heating device based on the lamp heating system described in (1) and its heat control will be described. This example is described referring to a lamp heating system, but the control method should not be limited to this.

This embodiment is a heating device for fixing toner images to recording paper and is to control the fixing temperature within the predetermined range when the above cooling process is implemented.

Figure 18A:
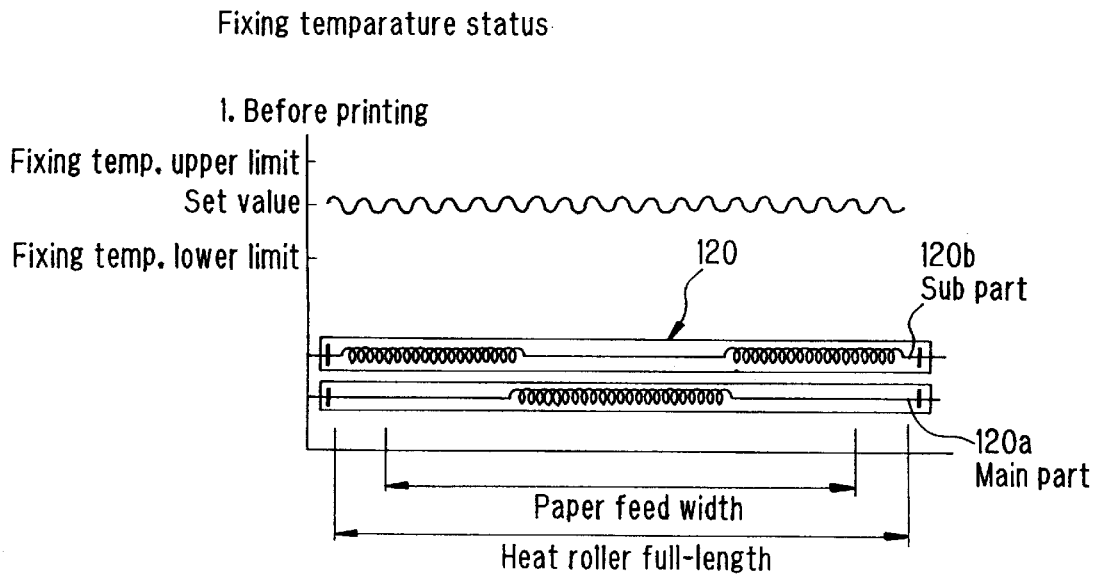
FIGS. 18A, 18B and 18C are illustrative views showing the configuration of a heat roller and the heat fixing temperature distributions.

The heating device according to this embodiment employs a direct heating system using a halogen lamp as its heat source. As sectionally shown in FIG. 18A, a halogen lamp 120 of the heating device is comprised of three parts, one middle part and two side parts. Here, the middle part is called main part 120*a* and the parts at both ends are called sub parts 120*b*. Main part 120*a* and sub parts 120*b* are temperature controlled independently. It should be noted that the method of dividing main part 120*a* and sub parts 120*b* is not limited to the above division, but various divisions such as dividing the width from one side as a reference point.

Next, description will be made of the temperature distributions during fixing when paper of large size and paper of small size are subjected to the fixing process in the above heating device. Here, paper of small size indicates small-width paper having a small width compared to the heating width of the heating element. The apparatus can compare the size of paper, which is requested for printing, with the heating width of the heating element provided in the device, so as to determine whether the paper is of large size or of small size.

Figure 18B:
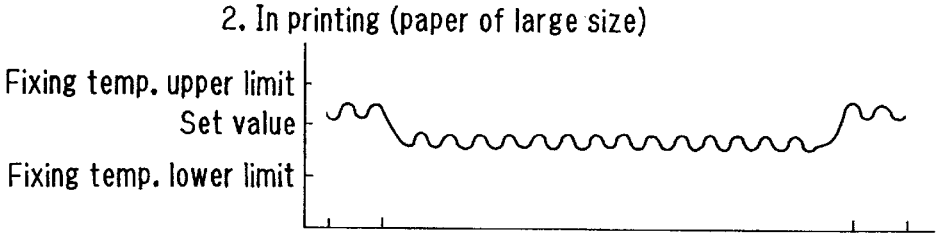

FIG. 18B is a chart schematically showing the temperature distribution during fixing of paper of large size. In this chart, temperature fluctuations attributed to spatiality are depicted in an exaggerated manner. Since the paper is of large size or as large as the heating width of the heat source, heat flows substantially uniformly from the heat source through the heat roller to the paper. Accordingly, the temperature distribution across the heating device is approximately uniform. The almost uniform temperature with little variations falls within the functional fixing temperature range.

Figure 18C:
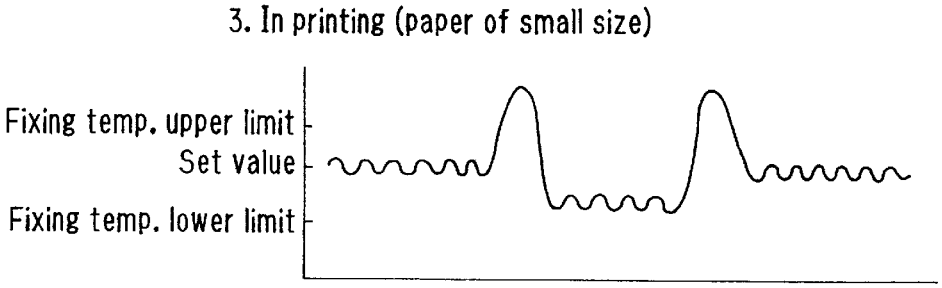

On the contrary, FIG. 18C is a chart schematically showing the temperature distribution during fixing of paper of small size. Since the paper is of small size or as large as the heating width of the main part 120*a*, heat flows substantially uniformly from the main part 120*a* to the paper. Accordingly, the temperature distribution across the main part 120*a* is approximately uniform. However, there is a difference in temperature between the main part 120*a* and sub parts 120*b*. Further, since no paper is present at the boundaries in contact with sub parts 120*b*, heat from main part 120*a* flows out to sub parts 120*b* so heat builds up at these areas corresponding to the sub parts 120*b*. When paper of a size narrower than the main part 120*a* is used, heat may build up at the areas between the heating edge of main part 120*a* and the edge of the paper feed area of the small-sized paper. Particularly, heat is apt to build up at the boundaries between main part 120*a* and sub parts 120*b*, as illustrated. Therefore, in the case of the chart, though the average temperature across the heating device falls within the functional fixing temperature range, the temperature around the boundaries between main part 120*a* and sub parts 120*b* or in partial areas within the main part 120*a* becomes higher than the upper limit of the functional fixing temperature range.

The scheme of the cooling process in the above heating device will be described with reference to the timing chart shown in FIG. 19.

Figure 19:
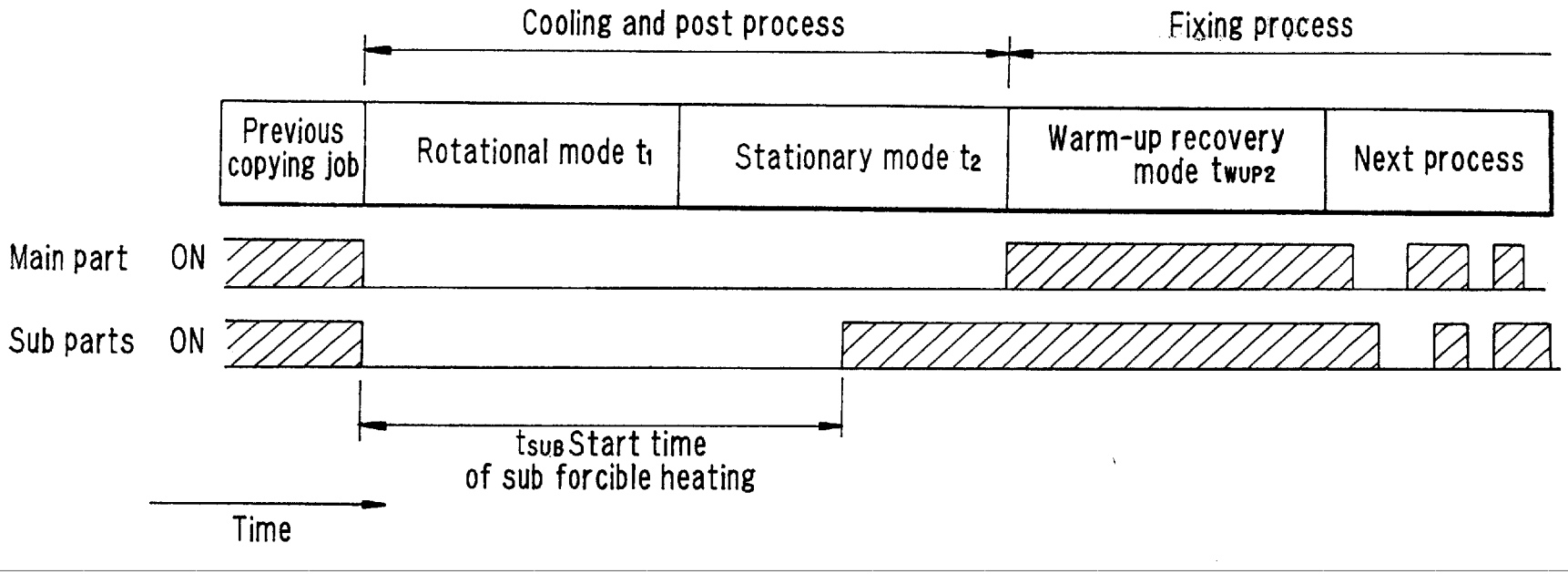
FIG. 19 is a timing chart showing a process including rotational-mode and stationary-mode cooling periods, once for each.

In FIG. 19, the top row shows the operational sequence of the cooling process of the heating device and the operation of the heating device during fixing. The middle row shows the activation timing of main part 120*a*, being among the divided heat sources. The bottom row shows the activation timing of sub parts 120*b*, being among the divided heat sources.

As shown in the top row of the chart, in this embodiment, the rotational mode is effected as the first step of the cooling process and then the stationary mode is effected as the second step. This operational sequence is the same as the flowchart in FIG. 11. As shown in the middle and bottom rows, during the cooling process main part 120*a* is deactivated and sub parts 120*b* alone are energized.

Next, in order to explain the result from the above operation, discussed below is the temperature distribution of the heating device after the cooling process alone was performed during the fixing operation of paper of small size and the temperature distribution of the same when the cooling process was effected while temperature control by power activation was implemented in parallel.

Figure 20:
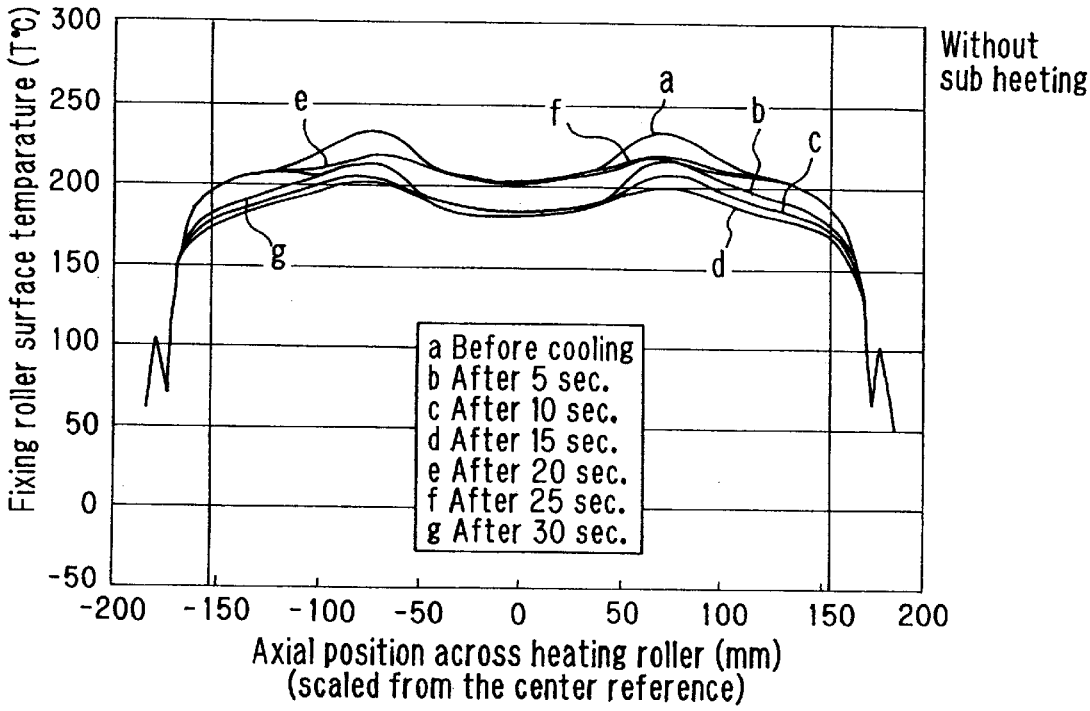
FIG. 20 is a chart showing temperature distributions in a heating device, changing dependent on time, when a cooling process alone is implemented.
Figure 21:
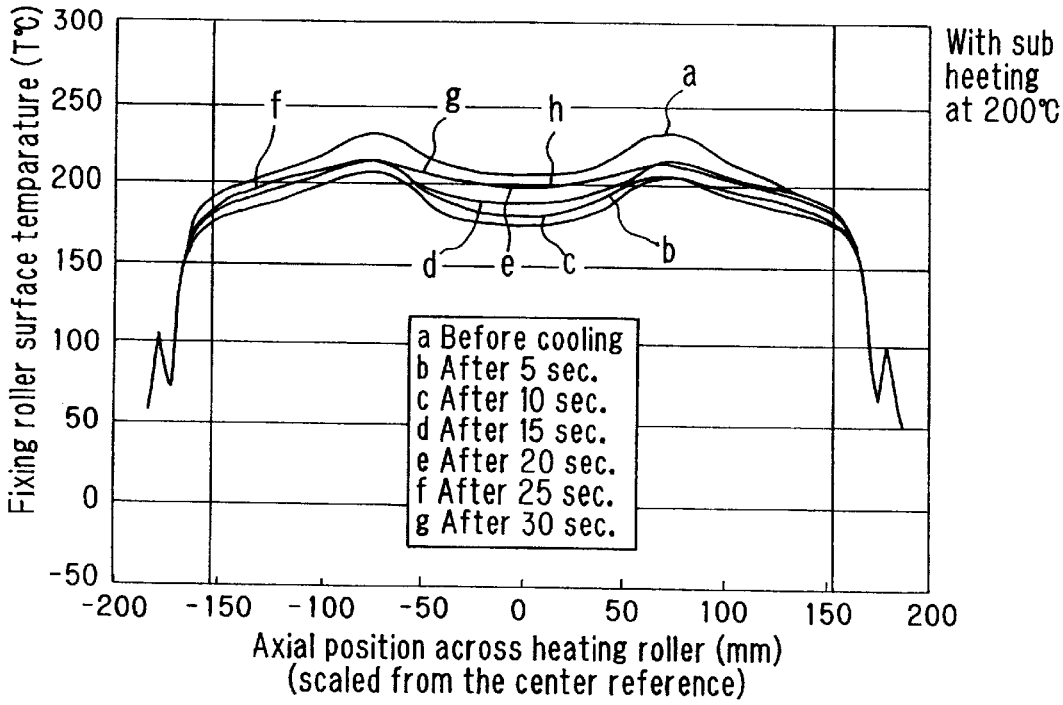
FIG. 21 is a chart showing temperature distributions in a heating device, changing dependent on time, when a cooling process is implemented in combination with auxiliary heating by activating sub elements.

FIG. 20 is a chart showing temperature distributions across the heating device, changing dependent on time, when the cooling process alone is implemented. FIG. 21 is a chart showing temperature distributions across the heating device, changing dependent on time, when the cooling process is implemented in combination with auxiliary heating by energizing sub parts 120*b*.

In the cases shown in FIGS. 20 and 21, the initial temperature distributions are almost the same, but after 30 sec. the temperature distribution in the case where auxiliary heating was performed was higher by almost 10 degrees on average than the temperature distribution in the case where no auxiliary heating was performed.

With concern to the above result, the 10 degrees of difference in fixing temperature will greatly affect the fixing performance. Further, the 10 degrees of difference will have a markedly great influence on the temperature deviation at the end portions from the functional fixing temperature range. Accordingly, partial power activation of the divided heat sources during the cooling process makes fine temperature control possible.

Figure 22:
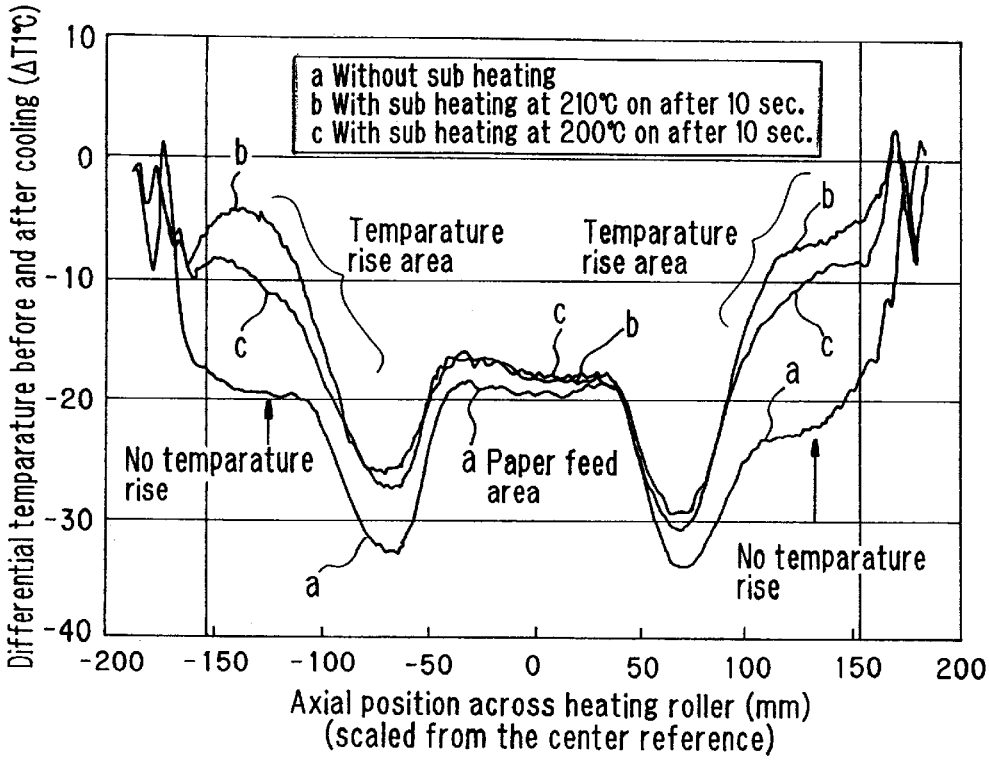
FIG. 22 is a chart showing differential temperature distributions before and after a cooling process, comparatively showing the effects owing to auxiliary heating.
Figure 23:
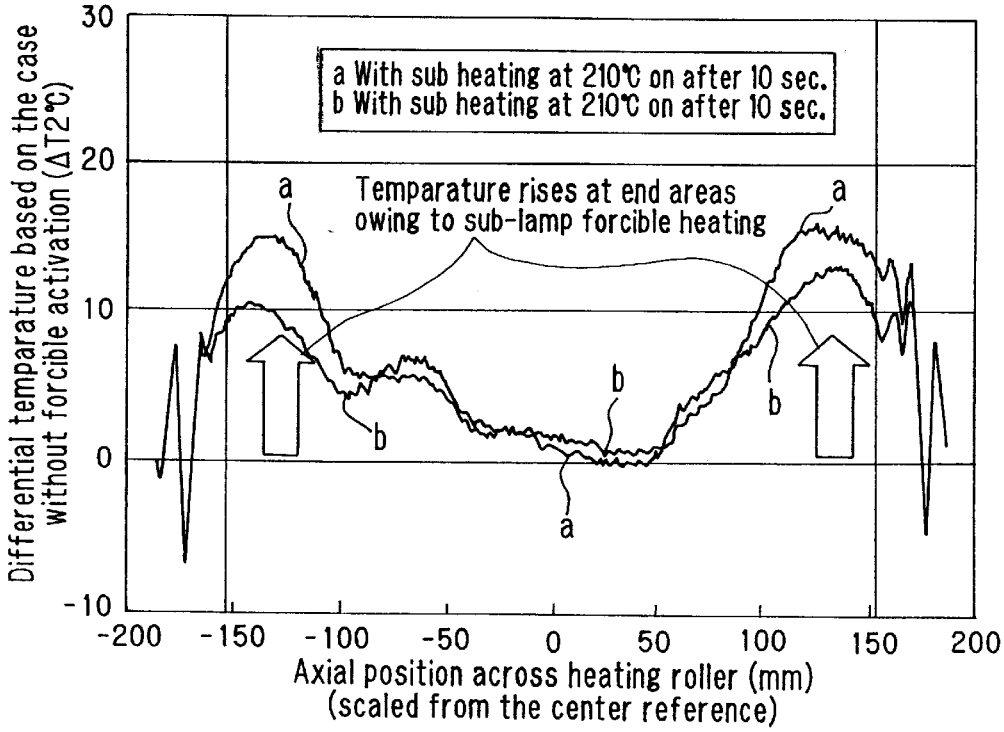
FIG. 23 is a chart showing differential temperature distributions when auxiliary heating is implemented, compared to that when no auxiliary heating is implemented.

FIGS. 22 and 23 are charts showing the actual situation of temperature control when the embodiment is applied to a fixing unit of the present invention.

FIG. 22 is a chart showing differential temperature distributions before and after the cooling process, comparatively showing the effects owing to execution of auxiliary heating. FIG. 23 is a chart showing differential temperature distributions when auxiliary heating is implemented, compared to that, in FIG. 22, when no auxiliary heating is implemented. That is, FIG. 23 depicts how the temperature can be restored when auxiliary heating is implemented. Accordingly, using the either or both of FIGS. 22 and 23, it is possible to make comparison with temperature rises in FIGS. 20 and 21.

Thus, the heating device according to the present invention is configured so that two modes of operation, which produce different effects on lowering the surface temperature of the heat roller are implemented as appropriate in an alternate manner. Therefore, it is possible to quickly adjust the heating roller to the correct temperature range by cooling the overall temperature and making the temperature distribution across the length uniform.

Since in the heating device according to the present invention, the heating sources are selectively energized so as to make temperature control, it is possible to prevent the heating device from partly lowering in temperature from the functional fixing temperature range.

In the above way, in the heating device according to the present invention, multiple heat sources spatially arranged are controlled independently for temperature control. Therefore, even when the heating element has had an uneven temperature distribution, the areas in which the temperature is about to deviate from the functional fixing temperature range can be selectively and efficiently heated so that it is possible to make the temperature distribution across the full length of the heating element substantially uniform and restore the temperature distribution to the functional fixing temperature range.

In the heating device according to the present invention, since the heating elements are energized in the stationary mode only, it is possible to suppress power consumption in the rotational mode.

The heat roller has a temperature variation with respect to its thickness. In the rotational mode, only the topmost layer near the roller surface can be cooled while the interior part of the roller remains at a higher temperature than that, so that a large temperature gradient arises near the surface. As a result, a large amount of heat dissipates temporarily after the operation is changed from the rotational mode to the stationary mode, so that power activation during this period is inefficient. Therefore, it is efficient that heating for temperature control is started after a certain period elapses or specifically, shortly before the end of the stationary mode, as illustrated above.

The 'start time of auxiliary forcible heating' shown in the bottom row in FIG. 19, is one of the operational setups to have been recorded beforehand in controller 110.

In the heating device according to the present invention, since, based on the previous study on the time until the heat flow reaches equilibrium, the start time of auxiliary forcible heating is determined, it is possible to make the whole heating element reach the functional fixing temperature range in a quicker and more reliable manner than the configuration where power activation is performed depending on sensor measurement only.

To divide the heat source, FIG. 18 shows that main part 120*a* and sub parts 120*b* are provided so as to be approximately equal in size. However, this is not essential. For example, if the full heating width is A4 size, the size of main part 120*a* may be set to be B5 size. In this case, the sub parts 120*b* are much smaller than main part 120*a*. This setting is convenient because the apparatus can deal with B5 size paper, which is often used. In FIG. 18, the heat source is divided into three parts, but can be separated into more parts though division into more parts increases the cost of manufacturing the heating device. As in the above embodiment, selecting one small size of paper in correspondence to one large size makes it possible to obtain maximum effect with minimum extra cost.

As another embodiment, the rotational mode and stationary mode can be alternately implemented several times. As an example, the rotational mode and stationary mode may be effected two times each. Operation in this case will be described with reference to the timing chart shown in FIG. 24.

Figure 24:
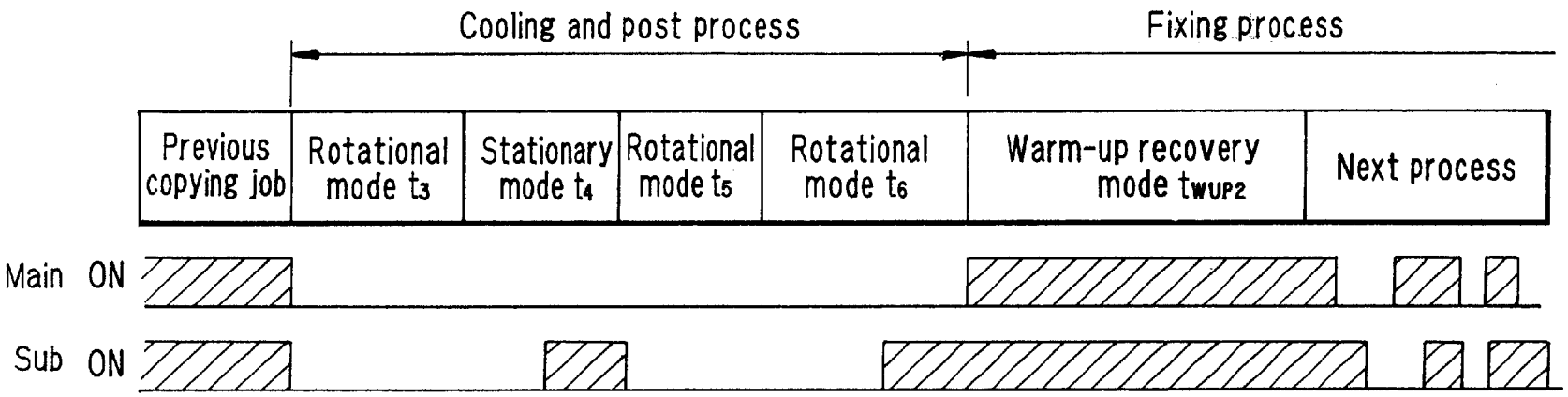
FIG. 24 is a timing chart showing a process including multiple, alternate rotational-mode and stationary-mode cooling periods.

As shown in the top row of the chart in FIG. 24, in this embodiment, the rotational mode is effected as the first step of the cooling process and then the stationary mode is effected as the second step. Further, the rotational mode is effected as the third step and the stationary mode is effected as the fourth step. As shown in the middle and bottom rows, during the cooling process, main part 120*a* is deactivated and lamp in sub parts 120*b* alone are activated. In this way, the rotational mode and stationary mode are repeated several times.

Thus, the heating device according to the present invention is configured so that two modes of operation which produce different effects for lowering the surf ace temperature of the heat roller are implemented as appropriate in an alternate manner. Therefore, it is possible to quickly adjust the heating roller to the correct temperature range by cooling the overall temperature and making the temperature distribution across the full length uniform.

Next, description will be made of an embodiment in which the operational settings for performing controls such as temperature adjustment etc., optimal for the cooling process have been recorded in advance in controller 110 provided in the heating device. Such operational settings include, for example, mode execution times, the number of mode repetitions, the temperature setup when temperature control is implemented.

It is possible to configure the system so that the above time settings can be done by the manufacturer of the apparatus. It is also possible to configure the system so that the settings can be modified by sensor control. It is further possible that the user may modify the settings at their disposal. In the present invention, at least one group of the set times is prepared and is used as default unless otherwise specified.

Figure 25:
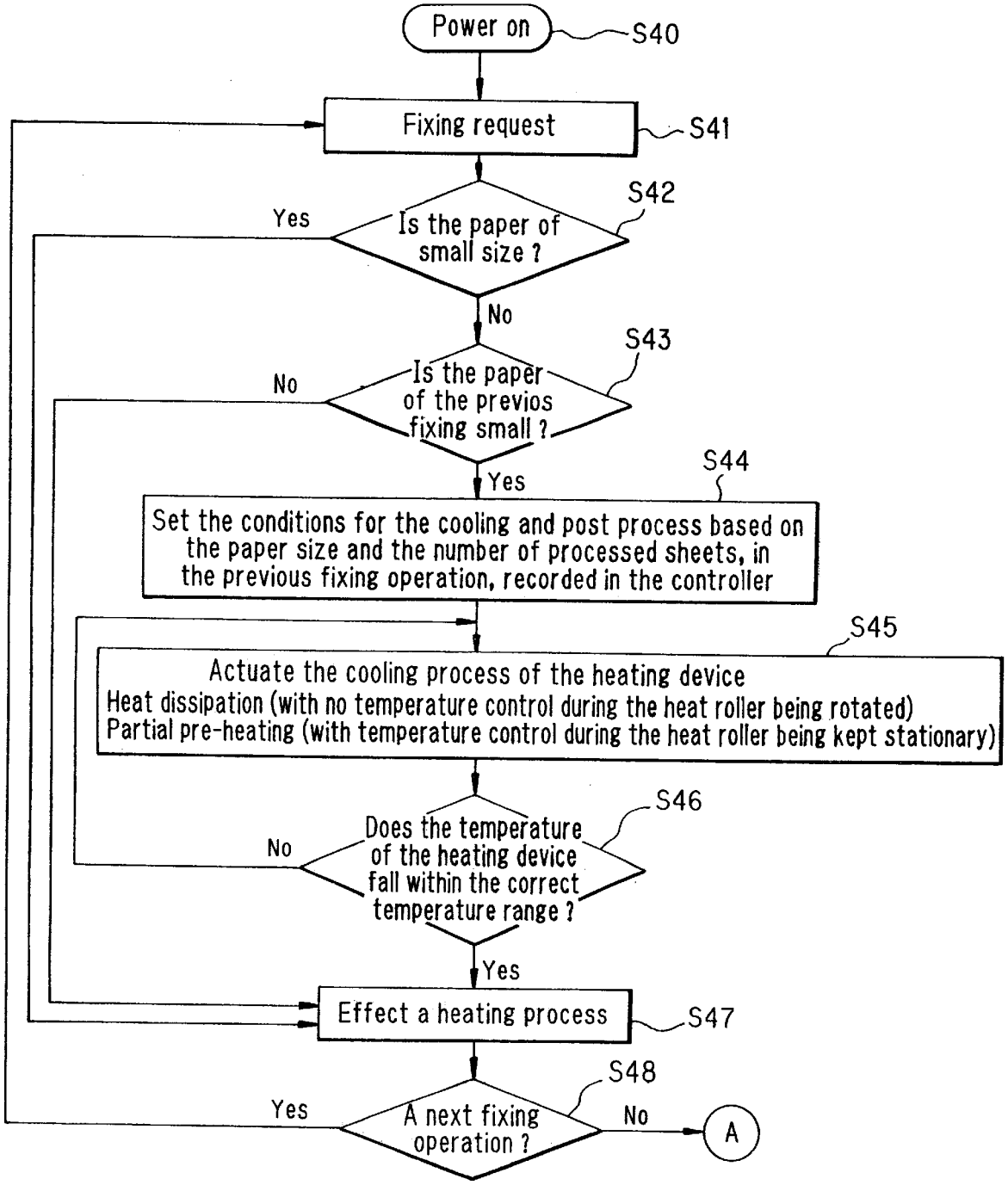
FIG. 25 is a flowchart for illustrating one example of a processing sequence of a heating device for implementing a cooling process consisting of multiple, alternate rotational-mode and stationary-mode cooling periods.
Figure 26:
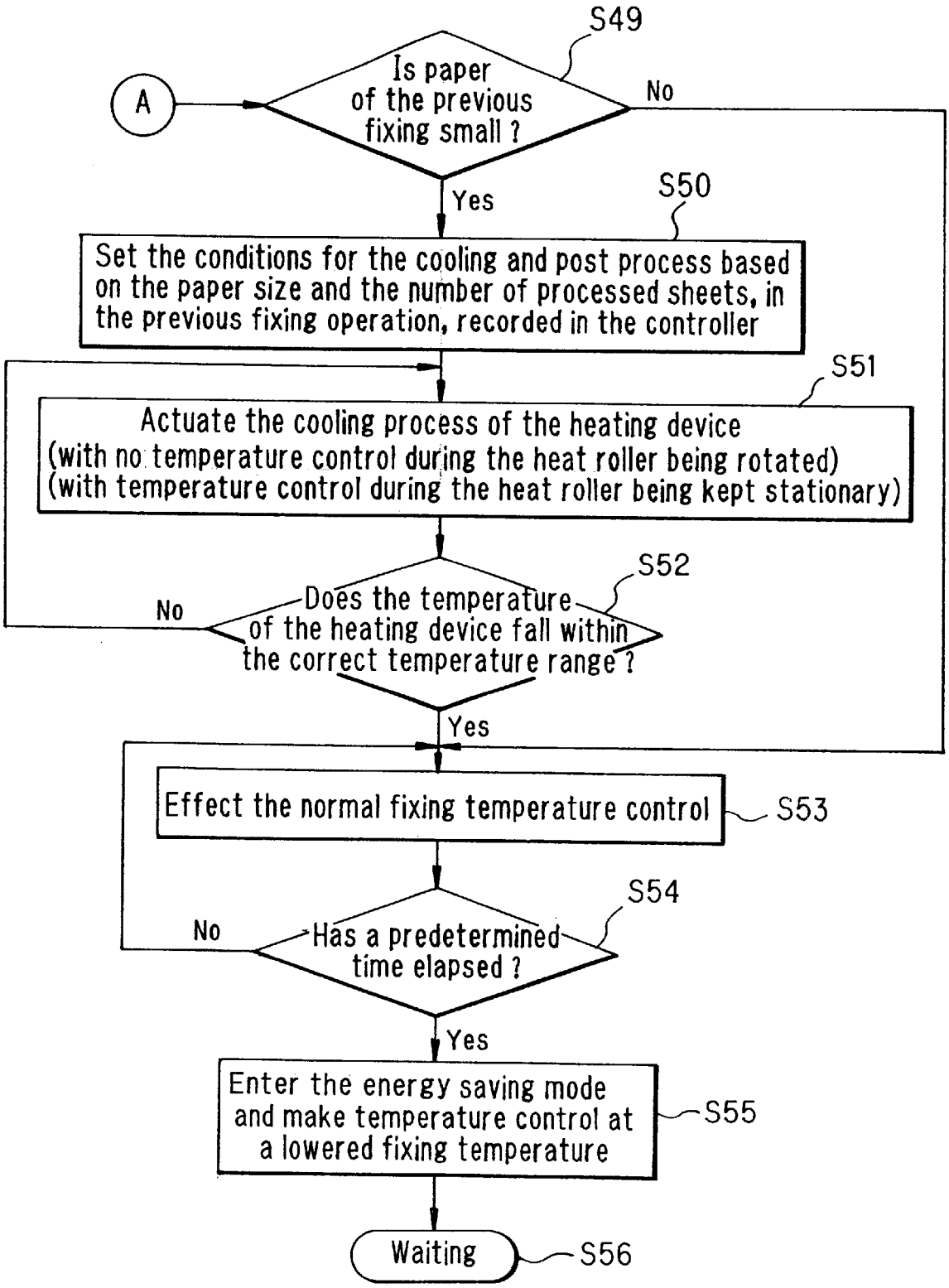
FIG. 26 is a flowchart showing the processing sequence of the heating device following the chart shown in FIG. 25.

The operation of the above heating device will be described with reference to the flowcharts in FIGS. 25 and 26.

To begin with, the heating device is energized at Step S40. Then the heating device accepts a fixing request at Step S41.

At the next step S42, it is determined whether the size of the current paper about to undergo the fixing operation of the heating device is of small size. If it has been determined to be of small size, the operation jumps to Step S47 where the fixing process is implemented. If not, the operation goes to the next step S43.

In the case where the paper size is not small, it is checked whether the paper size in the previous fixing operation of the heating device was small. If it has been determined to be of small size, the operation goes to Step S44. If not, the operation goes to Step S47 where the fixing process is implemented.

At the next step S44, the conditions for the cooling operation are set up based on the paper size and the number of processed sheets in the previous fixing operation, which have been recorded in the controller (provided in the heating device).

At Step S45, the heating device implements the cooling process based on the conditions set at the previous step. In the present embodiment, the rotational mode is effected with the heat source de-energized. In the stationary mode, the heat source is energized so as to perform temperature control. When the set operation completes, controller 110 checks whether the heating device restores the correct temperature at the next step S46. When it is determined that the correct temperature has been restored, the fixing process is implemented at the subsequent step S47. If it is determined that the correct temperature is not obtained, the operation returns to the previous step S45, so that the heating device starts another cycle of the cooling process. In this way, the cooling process will be repeated at Steps S45 and S46 until the heating device restores the correct temperature.

At Step S47, the heating device implements the fixing process of the requested fixing operation. Then, at Step S48, the heating device is set into the fixing wait mode, so as to check whether there is any fixing request which has not been accepted already. If there is, the operation returns to Step S41 to accept the fixing request. If there is no fixing request, the operation goes to Step S49.

In the sequence after Step S49, cooling and heat adjustment of the heating device are carried out in order to be able to start a fixing process, whatever the paper size of the next fixing operation is, as soon as a fixing request is made.

At Step S49, the heating device determines whether the paper size of the previous fixing is small. If it is not small, no cooling process is needed, so that at Step S53 the normal fixing temperature control is effected. If it is of small size, the operation goes to Step S50, from which the cooling process is implemented. When the paper is of a small size, or at Step S50 the operational conditions for the cooling process are set up based on the paper size and the number of processed sheets of the previous fixing, recorded in controller 110.

Next, at Step S51, the heating device implements the cooling process based on the setting at the previous step. When the modified operation ends, at Step S52 the controller checks whether the heating device has been restored to the correct temperature. If it is determined that the correct temperature has been regained, the operation goes to the next step S53, where the heating device implements the normal temperature control mode. When it is determined that the correct temperature has not been regained, the operation goes back to the previous step S51, where the heating device again implements the cooling process. In this way, the cooling process will be repeated at Steps S51 and S52 until the heating device is restored to the correct temperature.

At Step S53, the heating device implements the normal temperature control mode. Next, at Step S54, the heating device judges whether a predetermined time has elapsed. If the judgement is affirmative, the operation goes to Step S55, where the energy save mode is actuated. At Step S56, the system is set into the energy save mode so as to wait for a fixing request. In the heating device according to the present invention, if the paper processed by the previous fixing operation is of a large size, no cooling operation is implemented, so that the power which would be consumed by the cooling operation can be saved.

As stated above, the heating device according to the present invention is constructed such that the energy save mode in which the temperature range is set lower than that of the normal temperature control can be actuated. Therefore, a lower amount of electric energy is supplied to the heat source, hence it is possible to reduce power consumption compared to the normal temperature control mode. It is also possible to stop power supply to the heat source.

As stated above, for the heating device according to the present invention, the optimal periods of time for the rotational mode and the stationary mode should be determined beforehand based on the calculation or experimental measurement as to each combination of paper size and the number of processed sheets, and recorded in the controller. Since the thus recorded conditions are used for cooling, in some cases depending on the temperature distribution the heating element can be cooled more quickly than the sensor actuated cooling. In addition, there are cases where the heating element can be cooled more quickly than by the rotational mode alone or by the stationary mode alone.

In the above embodiment, the information as to the previous operation need not be stored in the controller. In this case, the operation control is carried out based on sensors. In this configuration using sensors, the sensors conventionally provided in the heating device can be utilized without adding extra components.

Further, it is possible to configure the system that when a next fixing request is received while the cooling process of the heating device is being implemented at Step S51, the operation goes to Step S41 so as to accept the fixing request, by interrupting the cooling process if the paper size of the aforementioned request is equal to the paper size of the previous fixing or smaller than that. In this case, power consumption can be reduced because the cooling process is stopped. It is also possible to configure the system that when a next fixing request is received while the cooling process of the heating device is being implemented at Step S51 and if the paper size of the aforementioned request differs that of the previous fixing, the cooling process is continued and then the operation goes to Step S41 instead of Step S53 after it is determined at Step S52 that the correct temperature has been reached, so as to accept the fixing request.

In this configuration, when a fixing request of paper different in size from that in the previous fixing operation is received while the cooling process is in progress, the cooling process will be continued until the predetermined conditions are satisfied and the temperature returns to the set temperature. Therefore, this configuration assures stable fixing quality.

<Image Forming Apparatus>

Figure 27:
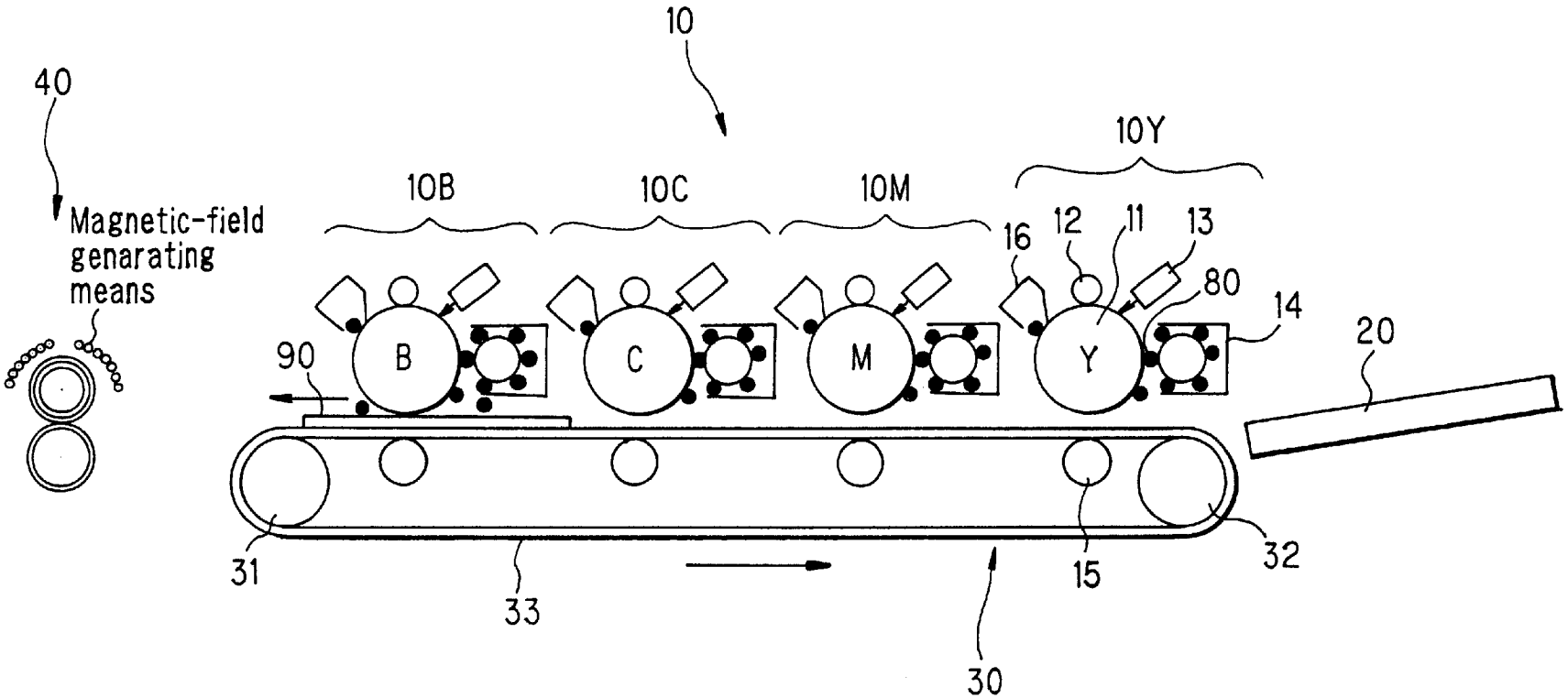
FIG. 27 is a diagram showing the schematic configuration of a color image forming apparatus to which the present invention is applied.

The heating device according to the present invention can be applied to a color image forming apparatus, for example, a so-called tandem-type printer, as shown in FIG. 27, in which four visual image forming units 10B, 10C., 10M and 10Y are arrayed along the recording media feed path.

In this printer, four visual image forming units 10B, 10*c*, 10M and 10Y are arranged along the recording media feed path between a feed tray 20 for stacking recording sheets (media to be heated) 90 and a fixing unit 40. While recording paper 90 is conveyed by a recording sheet conveying means 30 made of an endless belt, each color of toner 80 is transferred successively to the paper then the thus transferred colors of toners 80 are fixed by fixing unit 40, whereby a full-color image is formed.

Recording sheet conveying means 30 includes an endless conveyer belt 33 which is wound between a pair of rollers, namely drive roller 31 and idling roller 32 and controlled so as to be rotated at a predetermined peripheral speed (e.g., 134 mm/s). Recording paper 90 is electrostatically attracted to this conveyer belt 33 and conveyed thereby.

Each of visual image forming units 10B, 10*c*, 10M and 10Y has a photoconductor drum 11, around which a charging roller 12, laser beam emitting means 13, developing device 14, transfer roller 15 and cleaner 16 are arranged. Developing device 14 in each unit holds toner 80 of yellow (Y), magenta (M), cyan (C) or black (B). Each of visual image forming units 10B, 10C, 10M and 10Y forms a toner image on recording paper 90 by the following sequence.

First, the surface of photoconductor drum 11 is uniformly charged by charging roller 12, then is illuminated in accordance with the image information by the laser beam from laser beam emitting means 13 so as to have a static latent image formed thereon. Thereafter the static latent image on photoconductor drum 11 is developed into a toner image by developing device 14. The thus developed toner images are successively transferred to recording paper 90, which is being conveyed by conveying means 30, by respective transfer rollers 15, to which a bias voltage having a polarity opposite to that of toner 80 is applied.

Thereafter, recording paper 90 is separated from conveying belt 33 by virtue of the curvature of drive roller 31 and is fed into fixing unit 40. In the fixing unit, the paper with toners 80 thereon is pressed by and imparted with an appropriate temperature from the heat roller which is kept at a predetermined temperature, so that toners 80 are fused and fixed to recording paper 90 to be formed into a stable image.

The above-described heating device according to the present invention should not be limited to the fixing unit but can be applied to a dryer in a wet type electrophotographic apparatus, a dryer in an ink-jet printer, a heating device for an erasing device for rewritable media and other heating devices.

The image forming apparatus to which the heating device according to the present invention is applied should not be limited to color image forming apparatus, but can be applied to monochrome image forming apparatus forming monocolor toner images.

Also the peripheral speed should not be limited to 134 mm/s, but can be selected within the range of from some tens to some hundreds mm/s. For example, it can be set at 61 mm/s, 88 mm/s, 122 mm/s, 205 mm/s, etc.

Since the heating device according to the present invention has the configuration described heretofore, the following effects can be obtained.

First, according to the heating device of the present invention, a cooling process is actuated after the final recording medium has passed therethrough, in accordance with the recording media size, the cooling process which is constituted, by combination of a rotational mode in which the heating element and pressing element are rotated for a predetermined period and a stationary mode in which the heating element and pressing element are stopped from rotating for a predetermined period.

In the prior art, since the mode in which the heating element is rotated so as to cool it or the mode in which the heating element is left stationary so as to cool it was implemented alone, it used to take a long time to cool the heating element to a desired temperature, hence this configuration needed a long disabled image forming time, resulting in reduction in throughput.

In contrast to the above, in the heating device according to the present invention, instead of lowering the surface temperature of the heating element as in the prior art, the optimal rotational-mode and stationary-mode periods are determined in accordance with the size of recording media, whereby these two modes, rotational and stationary modes, are implemented for cooling and post process.

Accordingly, it is possible to lower the surface temperature of the heating element and pressing element more quickly compared to the conventional techniques.

Further, in the heating device of the present invention, the two modes produce individual influences different from each other on lowering the surface temperatures of the heat and pressing rollers. Specifically, in the rotational mode, the heat and pressing elements are rotated for a predetermined period. When the temperature distribution across the length of the heating element is observed in this state, the rotational mode functions such that the differential temperature between the non-media feed areas which has been overheated and the media feed area cannot be reduced to a small enough level but the maximum temperature in the non-media feed areas lowers or the temperature across the whole part totally lowers at a high temperature drop rate.

On the other hand, in the stationary mode, the heat and pressing elements are stopped from rotating for a predetermined period. When the temperature distribution across the length of the heating element is observed in this state, the stationary mode functions such that though the surface temperature of the heating element cannot lower at as high a temperature drop rate as that in the rotational mode, the differential temperature between the non-media feed areas and the media feed area can be markedly reduced compared to the rotational mode.

Accordingly, it is possible to lower the temperature in the overheated non-media feed areas more quickly by implementing the rotational mode and the stationary mode for predetermined periods in accordance with the size of recording media. Therefore, it is possible to quickly restore the normal state from the condition in which occurrence of wrinkles and image deficiencies such as high-temperature offset may arise as wall as avoiding reduction in throughput of image forming.

Further, it is also possible to avoid the non-stick layer and primer being exposed to a heat-degradation environment.

In the control method of the heating device according to the present invention, the rotational mode may be effected first and then be followed by the stationary mode; or the stationary mode may be effected first and then be followed by the rotational mode.

More specifically, when the surface temperatures of the heating element and pressing element are lowered, the behavior of temperature reduction of the surface temperature differs depending on the configurations (outside diameter, wall thickness, material, heat treatment, etc.) and cooling characteristics of the heating element and pressing element, the type and heating power of the heat source for heating the heating element and pressing element, the structure of the heating device, ambient environments, and other factors. Therefore, other than setting the execution times of the above two modes, the sequential order of implementing the rotational modes and stationary modes may be changed in accordance with the needed temperature distribution, utilizing the difference between the modes in exerting effects on the temperature reduction.

By achieving such control, it is possible for the heating element and pressing element to restore their temperature distributions meeting the specifications of the heating device in a quicker manner.

Further, in the control method of the heating device according to the present invention, the heat source for heating the heating element and pressing element can be de-energized in at least one of the modes, the rotational and stationary modes.

As well known, the heat source for heating the heating element and/or pressing element is kept at a predetermined temperature by the controller. In a case where a next image forming process is present after the final recording medium of current consecutive feed of recording media has passed through, it is possible to set the apparatus at the standby for the next image forming process more quickly if the heating element and pressing element are heated by the heat source.

However, in order to decrease the surface temperatures of the heating element and pressing element in a quicker manner, the heat source is preferably kept deactivated, and this control can enhance the temperature lowering rate and can realize the desired temperature distribution more quickly.

Roughly specking, in the heating device of the present invention, the rotational-mode operation decreases the temperature of the whole heating element by a certain amount while the stationary-mode operation make the temperature across the whole part of the heating element uniform. In the present invention, temperature control may be effected even in the rotational mode, which is mainly aimed at cooling. Therefore, it is possible to prevent the heating element from partly lowering below the predetermined temperature range (e.g., functional fixing temperature range). For example, there is a risk that if solitary cooling of a heating element having an uneven temperature distribution is performed, part of the heating element lowers its temperature too much, deviating from the predetermined temperature range. To avoid such a situation, the heat source provided for heating element is energized so as to perform temperature control, whereby it is possible to eliminate the risk of the deviation from the specified temperature range.

According to the heating device of the present invention, the operational conditions of the cooling process is set based on the recording media information. Specifically, the optimal conditions (such as execution periods of time) for the rotational mode and the stationary mode should be determined beforehand based on the calculation or experimental measurement as to each combination of recording media size and the number of processed sheets, and recorded in the memory, or the like. Further, the recording media size and the number of processed sheets in the previous thermal fixing process should be temporarily stored.

Then the operational conditions for the cooling process are determined by contrasting the recording media information with the optimal conditions. Therefore, a further reliable setting of operational conditions can be achieved. As a result, it is possible to implement the cooling operation in an efficient manner.

According to the heating device of the present invention, the rotational mode is roughly aimed at cooling the heating element. In other words, the rotational mode is a mode in which heat dissipation is intensified intentionally. Accordingly, there could occur a situation where temperature control is substantially inefficient while cooling is being effected in the rotational mode, in which heat will dissipate greatly.

From this viewpoint, in the above configuration the device is energized only in the stationary mode and no current is supplied in the rotational mode. This makes it possible to reduce power consumption.

On the other hand, the heating element or heat roller has a temperature variation with respect to its thickness. In the rotational mode, only the topmost layer near the roller surface can be reduced in temperature while the interior part of the roller remains at a higher temperature than that, so that a markedly large temperature gradient arises near the surface. When the operation is changed from the rotational mode to the stationary mode, heat transfers or spreads uniformly from the roller interior toward the roller surface, hence a greater amount of heat dissipates for the time being.

That is, when and after the operation mode has been changed from the rotational mode to the stationary mode, heat dissipation dominates so that it is almost impossible to make temperature control even by supplying an electric current. From this viewpoint, in the above configuration, it is preferred that power activation or heating for temperature control is started when a fixed time has elapsed after the shift to the stationary mode, or in particular, shortly before the end of the stationary mode. This makes it possible to achieve temperature control in an efficient manner.

According to the heating device of the present invention, the cooling process is effected and controlled dependent on the media size. Therefore, it possible to efficiently effect the cooling process, whereby it is possible to avoid increase in running cost of the heating device in the image forming apparatus.

In the heating device of the present invention, the temperature of the heating element needs to be maintained within the predetermined temperature range in order to achieve efficient heating. This temperature ready for heating should be maintained in the normal temperature control. A specific method of the temperature control is realized by energizing the heat source provided for the heating element, based on temperature sensor detection. However, since this control also continues during periods in which no heating operation is needed, there has been a problem of increase in power consumption due to wasteful energizing.

To avoid the above situation, in the present invention, the energy saving mode is introduced in which the temperature range is set lower than that of the normal temperature control. Accordingly, current supply to the heat source decreases hence it is possible to reduce power consumption compared to the normal power control. As a result, it is possible to reduce the running cost of the heating device.

It should be noted that the predetermined time set for the device to shift into the energy saving mode may be set when the image forming apparatus is manufactured or may be set at user's disposal.

According to the heating device of the present invention, when the recording media in the preceding heating operation is of a large size or has a length greater than the circumference of the roller element with respect to the conveying direction and the recording media in the subsequent heating operation is of the same size, no cooling process will be effected.

That is, if the paper as the recording media in the previous operation and that of the current operation have an equal, large size, the heat capacities of the sheets are equivalent. Therefore, the temperature distribution across the heating element may fall within the predetermined temperature range and becomes almost uniform. Accordingly no cooling process is needed, hence power consumption for the cooling process can be avoided. When this control is implemented, the normal heating control is effected instead of a cooling process.

According to the heating device of the present invention, the rotational and stationary modes produce individual influences different from each other for reducing the surface temperature of the heating element. Appropriate alternation of the two modes enables fine temperature adjustment in cooling the temperature and making the temperature distribution uniform. As a result, it is possible to lower the overall temperature and make uniform the temperature distribution as a whole, in a more efficient manner, compared to the case where temperature reduction and uniformity of the temperature distribution is controlled in rough steps of temperature. Therefore, it possible to adjust the heating element to a preferable temperature in a quicker manner.

In the above configuration, when the process is started with the rotational mode, the process is followed by the stationary mode, the rotational mode as such, and can be ended either in the rotational mode or the stationary mode after the alternation of the two modes.

According to the heating device of the present invention, when the temperature of the heating element is overheated to a temperature beyond the predetermined temperature and is determined to deviate from the predetermined range, the rotational mode is actuated first. That is, since the rotational mode is effective in reducing the temperature as a whole, efficient temperature control can be made by giving priority to cooling performance when the temperature is high.

According to the heating device of the present invention, when it has been determined that the mean temperature of the heating element falls within the predetermined range but the spatial temperature distribution has strong fluctuations, the stationary mode is actuated first. That is, since the stationary mode is effective in making the spatial temperature distribution uniform, efficient temperature control can be made by giving priority to uniformity when the temperature distribution has strong fluctuations.

According to the heating device of the present invention, since a multiple number of heating areas are independently controlled on temperature, the heating element can be heated in accordance with the recording media's heat capacity (recording media size). Therefore, it is possible not only to avoid generation of unnecessary heat but also control the temperature distribution with a higher precision. Further, even if the temperature of the heating element lowers and the temperature distribution becomes uneven, it is possible to re-adjust the heating element so that the temperature distribution falls within the correct temperature range, by selectively controlling the heating areas on temperature.

For the aforementioned multiple heat areas, a multiple number of independent heat sources may be provided. Alternatively, a single heat source may be configured by devising the shape so that it may have a multiple number of divided heating parts for the different heating areas. These heating areas may have portions overlapped with each other.

According to the heating device of the present invention, the operational conditions for the cooling process is set based on the temperature information obtained from the temperature sensors. Therefore, it is possible to execute a more preferable cooling process. Examples of the operational conditions include the period of time for effecting each mode, the repeated number of times of each mode, and also the temperature settings if temperature control needs to be performed.

What is claimed is:

1. A heating device having a heating element including a heat source and a pressing element put in pressing contact with the heating element, wherein recording media are passed through and between the two elements so as to heat the media, the heating device comprising:

a rotational drive means for rotating the heating element and pressing element; and a control means for making control of each part so as to implement a cooling process for cooling the heating element, wherein the control means makes control during the cooling process so that the temperature of the heating element is maintained so as to fall within a predetermined range;

characterized in that when the final recording medium in a consecutive heating operation of recording media of a solitary size has passed through and between the heating element and pressing element, the control means implements two different modes in combination in accordance with the size of the recording media, the rotational mode in which the heating element and pressing element are rotated by the rotational drive means for a predetermined period of time and the stationary mode in which the heating element and pressing element are stopped rotating by the rotational drive means for a predetermined period of time.

2. The heating device according to claim 1, wherein the control means implements the stationary mode after the operation in the rotational mode.

3. The heating device according to claim 1, wherein the control means implements the rotational mode after the operation in the stationary mode.

4. The heating device according to claim 1, wherein the control means deactivates the heat source while the operation is being implemented in at least one of the modes, the rotational and stationary modes.

5. The heating device according to claim 1, wherein the control means set the operational conditions for the cooling process, based on the optimal cooling process conditions stored beforehand and the recording media information at least including the size of recording media and the number of media in the previous heating process.

6. The heating device according to claim 1, wherein the control means makes control so as to keep the temperature within the predetermined range when the operation is implemented in the stationary mode.

7. The heating device according to claim 1, further comprising: a recording media size detecting means for detecting the size of recording media, wherein when the control means, after a previous heat process has been finished, confirms that a subsequent heat process should be implemented, the control means implements the cooling process if the recording media size detecting means indicates that the media size of the subsequent heat process is greater than that of the previous heat process, and the control means will not implement the cooling process if the media size of the subsequent heat process is equal to or smaller than that of the previous heat process.

8. The heating device according to claim 1 wherein the control means, after completion of the cooling process, actuates an energy save mode operation in which the temperature range of the heating element is shifted to another temperature range which is slightly lower to a certain degree than the predetermined temperature range and can be immediately restored to the predetermined temperature range.

9. The heating device according to claim 1, wherein the control means makes control such that the cooling process is stopped in accordance with the size of recording media passing through and between the heating element and the pressing element.

10. The heating device according to claim 1, wherein the control means makes control so that the rotational mode and stationary mode are repeated alternately a multiple number of times.

11. The heating device according to claim 1, wherein when the control means determines that the temperature of the heating element has been elevated, deviating from the predetermined temperature range, the control means makes control so that the rotational mode starts first.

12. The heating device according to claim 1, wherein when the control means determines that the mean temperature of the heating element falls within the predetermined range but the spatial temperature distribution has strong fluctuations, the control means makes control so that the stationary mode starts first.

13. The heating device according to claim 1, wherein the heating element includes a multiple number of heat sources assigned for different heating areas, and the control means makes temperature control of each heat source corresponding to an individual heating area, independently from others.

14. The heating device according to claim 1, further comprising a temperature detecting means for measuring the temperature of the heating element, wherein the control means sets the operational conditions for the cooling process, based on the temperature information obtained from the temperature detecting means.

15. An image forming apparatus for forming toner images on recording media, including, as a fixing unit for fixing toner images on the recording media, a heating device comprising:

a heating element including a heat source;

a pressing element put in pressing contact with the heating element;

a rotational drive means for rotating the heating element and pressing element so as to pass the recording media through and between the two elements so as to heat the media; and a control means for making control of each part so as to implement a cooling process for cooling the heating element, wherein the control means makes control during the cooling process so that the temperature of the heating element is maintained so as to fall within a predetermined range;

wherein when the final recording medium in a consecutive heating operation of recording media of a solitary size has passed through and between the heating element and pressing element, the control means implements two different modes in combination in accordance with the size of the recording media, the rotational mode in which the heating element and pressing element are rotated by the rotational drive means for a predetermined period of time and the stationary mode in which the heating element and pressing element are stopped rotating by the rotational drive means for a predetermined period of time.

* * * * *